US011599043B2

(12) United States Patent
Shigehiro

(10) Patent No.: US 11,599,043 B2
(45) Date of Patent: Mar. 7, 2023

(54) DEVELOPING APPARATUS HAVING MULTI-BLADE PORTION REPLENISHMENT CONVEYANCE SCREW

(71) Applicant: CANON KABUSHIKI KAISHA, Tokyo (JP)

(72) Inventor: Koji Shigehiro, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/517,717

(22) Filed: Nov. 3, 2021

(65) Prior Publication Data

US 2022/0155709 A1 May 19, 2022

(30) Foreign Application Priority Data

Nov. 18, 2020 (JP) ..... JP2020-191309

(51) Int. Cl.
*G03G 15/08* (2006.01)

(52) U.S. Cl.
CPC ..... *G03G 15/0891* (2013.01); *G03G 15/0889* (2013.01); *G03G 15/0879* (2013.01); *G03G 15/0893* (2013.01); *G03G 2215/0822* (2013.01); *G03G 2215/0833* (2013.01)

(58) Field of Classification Search
CPC ..... G03G 15/0891; G03G 15/0889; G03G 2215/0822; G03G 2215/0833; G03G 15/0893; G03G 15/0879; G03G 2215/0838
See application file for complete search history.

(56) References Cited

U.S. PATENT DOCUMENTS

| | | | | |
|---|---|---|---|---|
| 8,971,770 | B2 | 3/2015 | Nakajima et al. | |
| 10,895,826 | B2 | 1/2021 | Ariizumi | |
| 2018/0017892 | A1 | 1/2018 | Shigehiro | |
| 2018/0335724 | A1* | 11/2018 | Shirayanagi ..... | G03G 15/0891 |

FOREIGN PATENT DOCUMENTS

| | | | |
|---|---|---|---|
| JP | 2010-256429 | A | 11/2010 |
| JP | 2014-134619 | A | 7/2014 |
| JP | 2018-116245 | A | 7/2018 |
| JP | 2020-020964 | A | 2/2020 |

* cited by examiner

*Primary Examiner* — Arlene Heredia
*Assistant Examiner* — Laura Roth
(74) *Attorney, Agent, or Firm* — Venable LLP

(57) ABSTRACT

A developing apparatus includes a replenishment conveyance screw portion to convey replenishment developer from a developer replenishment portion toward a first communication portion. First, second and third blade portions are formed in a spiral shape on an outer circumferential surface of a rotation shaft of the replenishment conveyance screw portion. A pitch of the first blade portion, a pitch of the second blade portion, and a pitch of the third blade portion are each larger than a pitch of a blade of a second conveyance screw portion, and the third blade portion is continuously formed in a region between a terminal end of the first blade portion and a starting end of the second blade portion.

9 Claims, 15 Drawing Sheets

DEVELOPING APPARATUS HAVING MULTI-BLADE PORTION REPLENISHMENT CONVEYANCE SCREW

BACKGROUND OF THE INVENTION

Field of the Invention

The present invention relates to a developing apparatus that develops an electrostatic latent image with developer.

Description of the Related Art

In an image forming apparatus employing an electrophotographic system or the like, an electrostatic latent image formed on an image bearing member such as a photosensitive drum is developed into a toner image by a developing apparatus. Specifically, the toner image is formed by causing a developer bearing member included in the developing apparatus to bear developer, and supplying the developer to the image bearing member in a developing portion. As such a developing apparatus, one using two-component developer including toner and carrier is conventionally used. In the case of a developing apparatus using two-component developer, the developer is conveyed in a circulation path in a developer container while being agitated.

As a screw that conveys the developer in the circulation path as described above, Japanese Patent Laid-Open No. 2010-256429 discloses a configuration in which a discontinuous portion that is discontinuous in the axial direction of a rotation shaft is provided in each blade of a multi-flight screw provided with a plurality of blades formed in a spiral shape around the rotation shaft.

Here, in a developing apparatus of a two-component developer system, image formation can be performed while maintaining a predetermined ratio of the amount of toner to the amount of carrier in the developing apparatus by newly replenishing developer consumed for development of an electrostatic latent image. In such a configuration, how well replenishment developer can be agitated until being conveyed to the developer bearing member has become important for suppressing occurrence of abnormal images.

Particularly, aggregation can occur due to thermal history during transportation of the replenishment developer, driving in a developer conveyance path of the image forming apparatus, or the like, and when an aggregate is unintentionally supplied to the developing portion, an image defect such as a stain image occurs. Therefore, breaking the aggregate by the conveyance screw conveying the developer is important for suppressing the stain image and improving the image quality.

Japanese Patent Laid-Open No. 2010-256429 described above discloses a screw configuration for improving the developer agitation performance. However, in the case of just improving the developer agitation performance of the conveyance screw in the circulation path of the developer as in Japanese Patent Laid-Open No. 2010-256429, there is a possibility that aggregates in the replenishment developer cannot be sufficiently broken.

SUMMARY OF THE INVENTION

The present invention improves the developer agitation performance of a replenishment conveyance screw provided in a replenishment conveyance path for conveying replenishment developer to a circulation path of developer to efficiently break aggregates in the replenishment developer in the replenishment conveyance path.

According to one aspect of the present invention, a developing apparatus includes a developer bearing member configured to convey a developer containing toner and carrier to a developing position while bearing the developer and a developer container configured to accommodate the developer. The developer container includes a first chamber for supplying the developer to the developer bearing member, a second chamber partitioned from the first chamber by a partition wall, a first communication portion configured to allow the developer to be communicated from the first chamber to the second chamber, a second communication portion configured to allow the developer to be communicated from the second chamber to the first chamber, a replenishment conveyance path for conveying replenishment developer to a circulation path in which the developer is circulated between the first chamber and the second chamber, and, a developer replenishment portion configured to supply the replenishment developer to the replenishment conveyance path. The developing apparatus includes a first conveyance screw portion provided in the first chamber and configured to convey the developer in a first direction from the second communication portion toward the first communication portion, a second conveyance screw portion provided in the second chamber and configured to convey the developer in a second direction from the first communication portion toward the second communication portion, and, a replenishment conveyance screw portion provided in the replenishment conveyance path and configured to convey the replenishment developer in a third direction from the developer replenishment portion toward the first communication portion. The replenishment conveyance path is provided upstream of the second chamber with respect to the second direction. The second conveyance screw portion is provided downstream of the first communication portion and upstream of the second communication portion with respect to the second direction. The replenishment conveyance screw portion is provided upstream of the second conveyance screw portion with respect to the second direction. A rotation shaft of the replenishment conveyance screw portion is coaxial to a rotation shaft of the second conveyance screw portion. The replenishment conveyance screw portion includes a first blade portion formed in a spiral shape on an outer circumferential surface of the rotation shaft of the replenishment conveyance screw portion and configured to convey the replenishment developer in the third direction, a second blade portion formed in a spiral shape on the outer circumferential surface of the rotation shaft of the replenishment conveyance screw portion and configured to convey the replenishment developer in the third direction, and, a third blade portion formed in a spiral shape on the outer circumferential surface of the rotation shaft of the replenishment conveyance screw portion and configured to convey the replenishment developer in the third direction. The third blade portion is continuously formed in a region between a terminal end of the first blade portion with respect to the third direction and a starting end of the second blade portion with respect to the third direction, the region being displaced in a circumferential direction of the replenishment conveyance screw portion from the terminal end of the first blade portion and the starting end of the second blade portion.

Further features of the present invention will become apparent from the following description of exemplary embodiments with reference to the attached drawings.

DESCRIPTION OF THE EMBODIMENTS

First Embodiment

Figure 1:
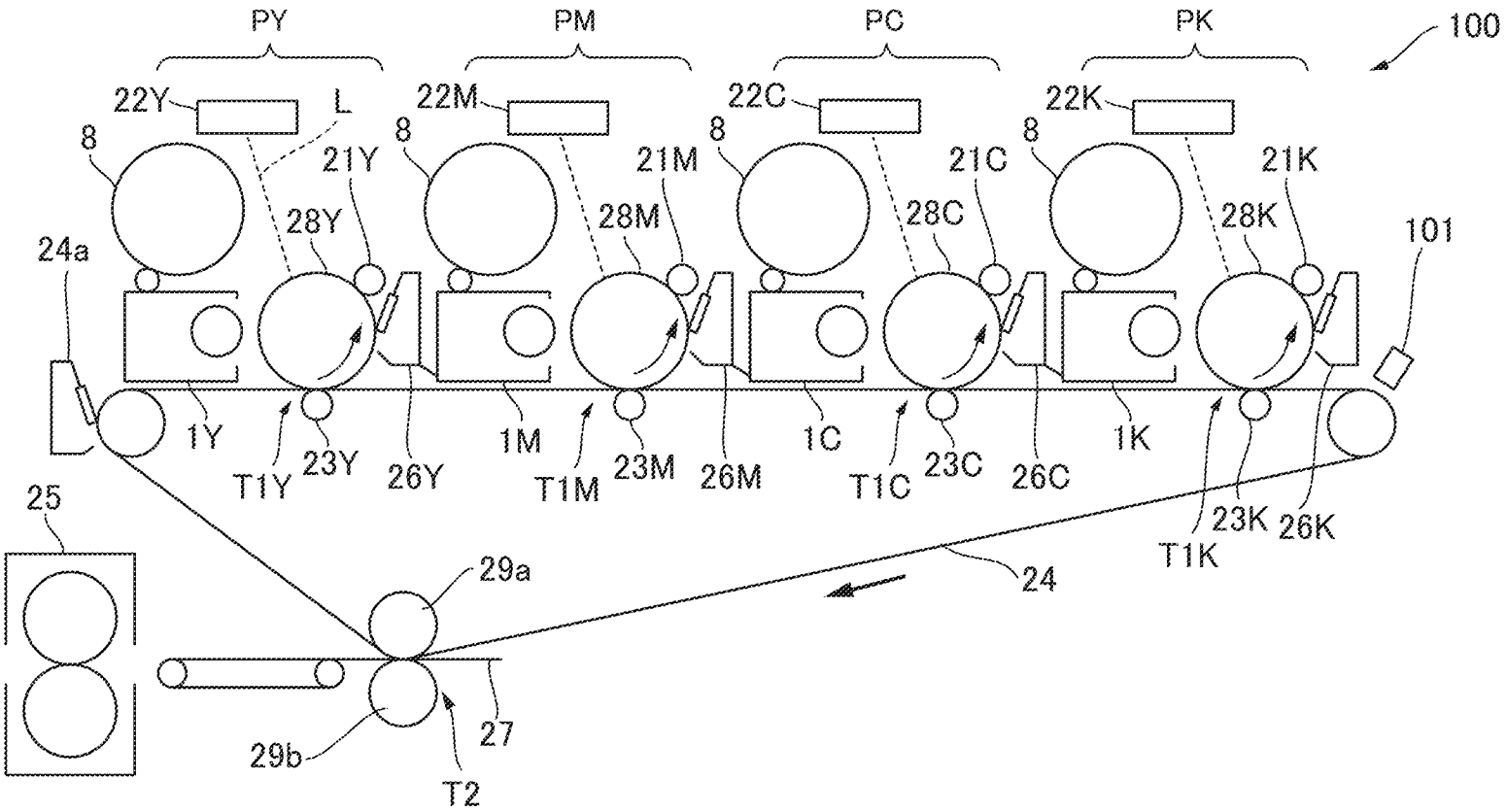
FIG. 1 is a schematic configuration diagram of an image forming apparatus according to a first embodiment.

A first embodiment will be described with reference to FIGS. 1 to 10B. First, a schematic configuration of an image forming apparatus of the present embodiment will be described with reference to FIG. 1.

Image Forming Apparatus

An image forming apparatus 100 is a full-color printer of an electrophotographic system including four image forming portions PY, PM, PC, and PK respectively provided in correspondence with four colors of yellow, magenta, cyan, and black. In the present embodiment, a tandem system in which the image forming portions PY, PM, PC, and PK are arranged along a rotation direction of an intermediate transfer belt 24 that will be described later is employed. The image forming apparatus 100 forms a toner image on a recording material 27 in accordance with an image signal received from a host device such as an unillustrated document reading apparatus connected to an image forming apparatus body or a personal computer communicably connected to the image forming apparatus body. Examples of the recording material include sheet materials such as paper sheets, plastic films, and cloths.

The outline of such an image forming process will be described. First, the image forming portions PY, PM, PC, and PK respectively form toner images of respective colors on photosensitive drums 28Y, 28M, 28C, and 28K. The toner images of respective colors formed in this manner are transferred onto the intermediate transfer belt 24, and then are transferred onto the recording material 27 from the intermediate transfer belt 24. The recording material 27 onto which the toner images have been transferred is conveyed to a fixing unit 25, and the toner images are fixed to the recording material 27. Detailed description will be given below. To be noted, the image forming portions PY, PM, PC, and PK are respectively constituted by drum cartridges respectively including the photosensitive drums 28Y, 28M, 28C, and 28K, and developing apparatuses 1Y, 1M, 1C, and 1K serving as developing cartridges. The drum cartridges and the developing cartridges are attachable to and detachable from the image forming apparatus body. Alternatively, a process cartridge in which these are integrated to be attachable to and detachable from the image forming apparatus body may be employed.

To be noted, the four image forming portions PY, PM, PC, and PK included in the image forming apparatus 100 have substantially the same configuration except that the development colors thereof are different. Therefore, the image forming portion PY will be described below as a representative, and elements of the other image forming portions are indicated by replacing a suffix "Y" of the reference signs of elements of the image forming portion PY by M, C, and K, respectively, and description thereof will be omitted.

The image forming portion PY includes a photosensitive member having a cylindrical shape, that is, the photosensitive drum 28Y, as an image bearing member. The photosensitive drum 28Y is rotationally driven in an arrow direction in FIG. 1 at a predetermined process speed that is a peripheral speed. A charging roller 21Y serving as a charging unit, a developing apparatus 1Y, a primary transfer roller 23Y, and a cleaning unit 26Y are disposed around the photosensitive drum 28Y. An exposing unit 22Y that is a laser scanner is disposed above the photosensitive drum 28Y in FIG. 1.

The charging roller 21Y is rotated in accordance with the photosensitive drum 28Y in image formation. The charging roller 21Y is urged toward the photosensitive drum 28Y by an unillustrated pressurizing spring. In addition, a charging bias is applied to the charging roller 21Y from a high-voltage power source. As a result of this, the photosensitive drum 28Y is approximately uniformly charged by the charging roller 21Y.

In addition, the intermediate transfer belt 24 is disposed to face the photosensitive drums 28Y, 28M, 28C, and 28K. The intermediate transfer belt 24 is stretched by a plurality of stretching rollers including a secondary transfer inner roller 29*a*, and circulates in an arrow direction in FIG. 1 by being driven by a driving roller included in the plurality of stretching rollers. A secondary transfer outer roller 29*b* serving as a secondary transfer member is disposed at a position opposing the secondary transfer inner roller 29*a* with the intermediate transfer belt 24 therebetween, and constitutes a secondary transfer portion T2 where a toner image on the intermediate transfer belt 24 is transferred onto the recording material 27. The fixing unit 25 is disposed downstream of the secondary transfer portion T2 with respect to a recording material conveyance direction.

A process for forming an image by the image forming apparatus 100 configured as described above will be described. First, when an image forming operation is started, the surface of the rotating photosensitive drum 28Y is uniformly charged by the charging roller 21Y Then, the photosensitive drum 28Y is exposed by laser light L corresponding to an image signal and output from the exposing unit 22Y As a result of this, an electrostatic latent image corresponding to the image signal is formed on the photosensitive drum 28Y The electrostatic latent image on the photosensitive drum 28Y is visualized with toner accommodated in the developing apparatus 1Y to be a visible image that is a toner image.

The toner image formed on the photosensitive drum 28Y is transferred onto the intermediate transfer belt 24 through primary transfer in a primary transfer portion T1Y formed between the photosensitive drum 28Y and the primary transfer roller 23Y arranged with the intermediate transfer belt 24 therebetween. Toner remaining on the surface of the photosensitive drum 28Y after the primary transfer is removed by the cleaning unit 26Y This toner will be also referred to as transfer residual toner.

This operation is also sequentially performed in the respective image forming portions of magenta, cyan, and black, and toner images of four colors are superimposed on one another on the intermediate transfer belt 24. Then, the recording material 27 accommodated in an unillustrated recording material accommodating cassette is conveyed to the secondary transfer portion T2 at a timing matching the toner image formation timing, and the toner images of four colors on the intermediate transfer belt 24 are collectively transferred onto the recording material 27 through secondary transfer. Toner remaining on the intermediate transfer belt 24 without being transferred in the secondary transfer portion T2 is removed by an intermediate transfer belt cleaner 24*a*.

Next, the recording material 27 is conveyed to the fixing unit 25. Then, the toner on the recording material 27 is heated and pressurized by the fixing unit 25 to be melted and mixed, and thus is fixed to the recording material 27 as a full-color image. Then, the recording material 27 is discharged to the outside of the apparatus. As a result of this, the series of processing of the image forming process is finished. To be noted, a monochromatic image of a desired color or an image of a plurality of desired colors may be formed by using an image forming portion of a desired color or image forming portions of desired colors.

Developing Apparatus

Next, the developing apparatus 1Y will be described with reference to FIGS. 2 to 4. To be noted, the same also applies to the developing apparatuses 1M, 1C, and 1K. The developing apparatus 1Y includes a developer container 2 accommodating a two-component developer containing nonmagnetic toner and magnetic carrier. Apart of the developer container 2 corresponding to a developing region facing the photosensitive drum 28Y is open, and a developing sleeve 3 serving as a developer bearing member is rotatably disposed to be partially exposed to this opening portion. A magnetic roller 4 is unrotatably disposed in a space enclosed by the developing sleeve 3.

Figure 2:
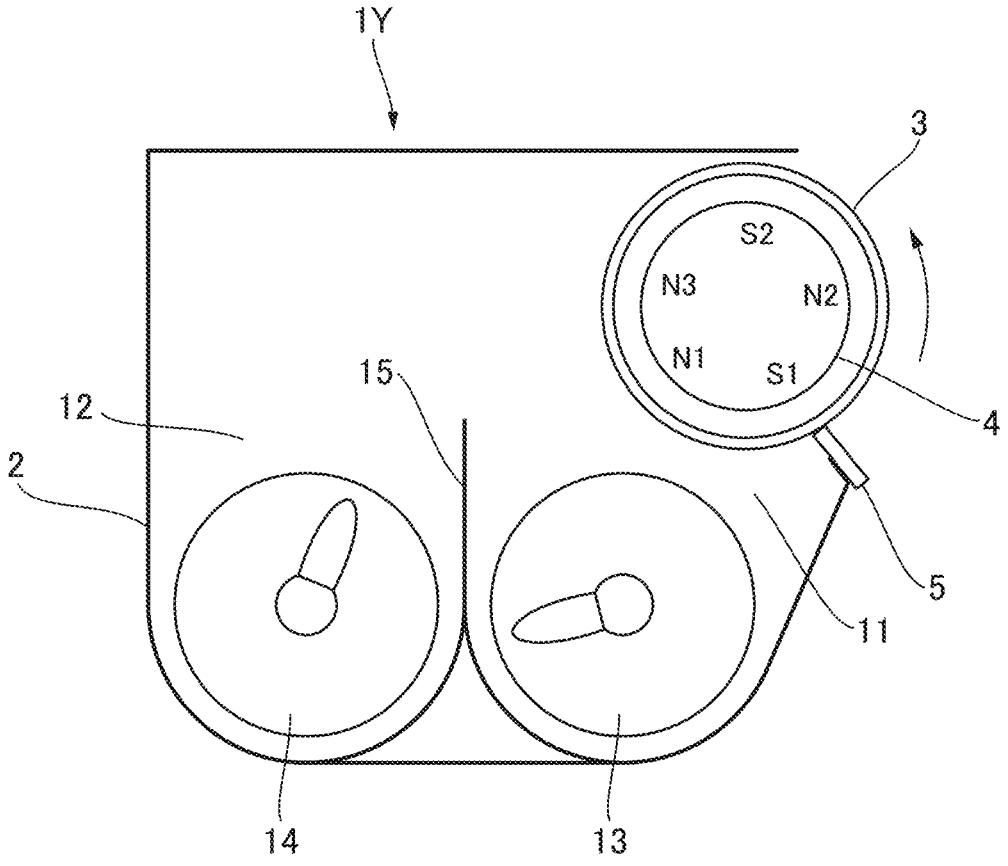
FIG. 2 is a schematic cross-sectional configuration diagram of a developing apparatus according to the first embodiment.

In the present embodiment, the developing sleeve 3 is formed from a nonmagnetic material, and rotates in an arrow direction of FIG. 2 at a predetermined process speed that is a peripheral speed in developing operation. The magnetic roller 4 serving as a magnetic field generation portion includes five magnetic poles of N1, N2, N3, S1, and S2 along the circumferential direction as a plurality of magnetic poles, and generates a magnetic field to cause the surface of the developing sleeve 3 to bear the developer.

Figure 3:
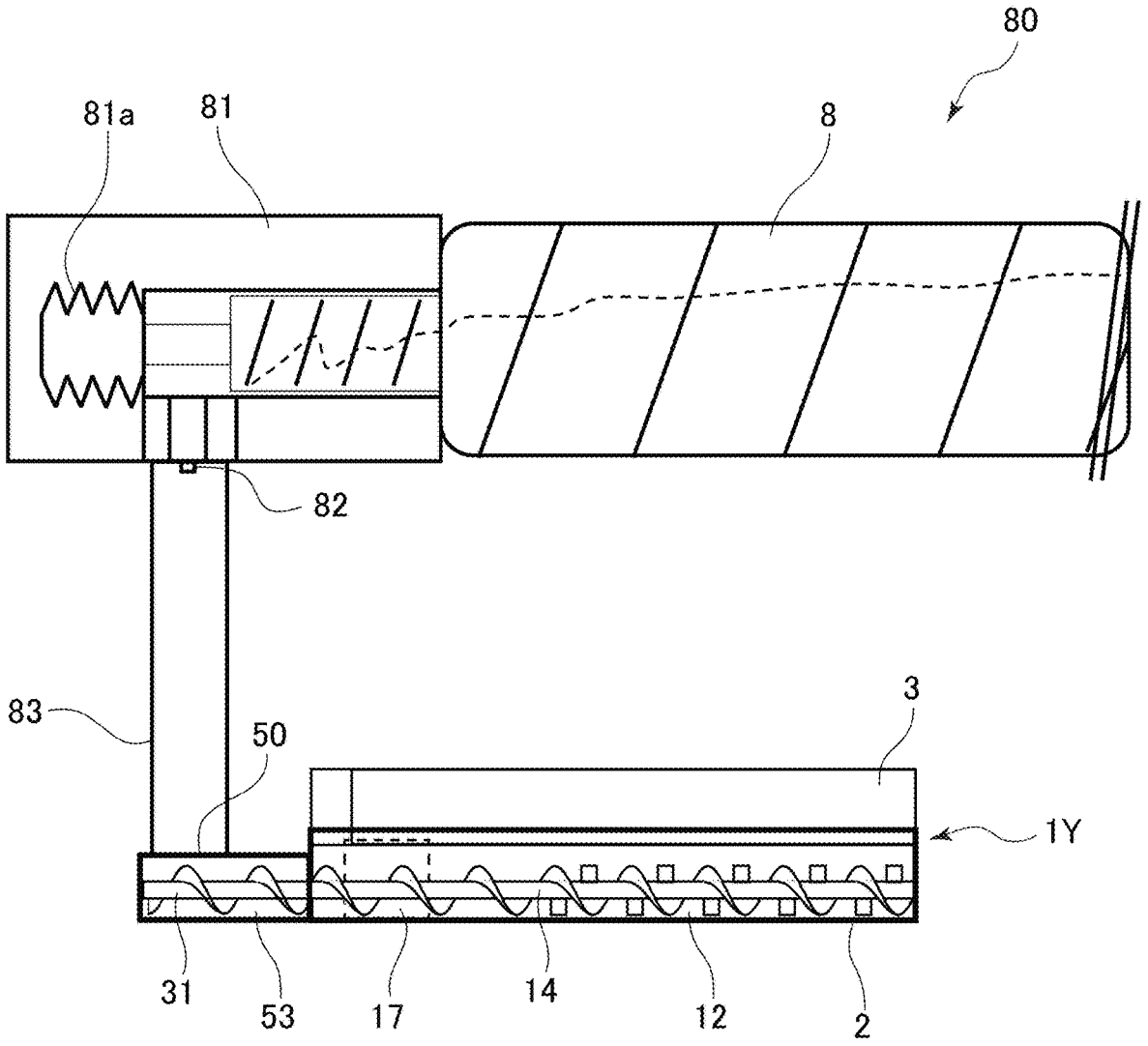
FIG. 3 is a schematic longitudinal-sectional configuration diagram of a replenishment unit and the developing apparatus.

That is, the developing sleeve 3 rotates in an arrow direction in FIG. 3, and conveys the developer attracted at the position of the N1 pole of the magnetic roller 4 serving as an attracting pole toward a blade 5 serving as a regulation member. The developer turned into a brush shape on the developing sleeve 3 by the S1 pole is turned into a developer layer of a predetermined layer thickness on the developing sleeve 3 by the blade 5 by passing through a gap between the developing sleeve 3 and the blade 5 while the amount thereof is regulated. Then, the developer layer is conveyed while being borne on the developing region opposing the photosensitive drum 28 serving as a developing portion or a developing position, and develops the electrostatic latent image formed on the surface of the photosensitive drum 28 in the state of forming a magnetic brush due to the N2 pole. The developer is conveyed to a nonmagnetic band present between the N3 pole serving as a peeling pole and the N1 pole after being supplied for development, and is peeled from the developing sleeve 3 and collected into a developer circulation path.

To be noted, in the present embodiment, the blade 5 is disposed below the developing sleeve 3 so as to regulate the developer at a position upstream of the developing region that is a portion where the photosensitive drum 28Y and the developing sleeve 3 oppose each other with respect to the rotation direction of the developing sleeve 3.

The inside of the developer container 2 is sectioned into a developing chamber 11 serving as a first chamber and a first conveyance path and an agitation chamber 12 serving as a second chamber and a second conveyance path by a partition wall 15 serving as a partition member extending in the vertical direction. As illustrated in FIG. 4, communication portions 16 and 17 each serving as a passing portion or a communication port and respectively communicating with the developing chamber 11 and the agitation chamber 12 are provided at respective ends of the partition wall 15 in the longitudinal direction that is the rotation axis direction of the developing sleeve 3. As a result of this, a developer circulation path is constituted by the developing chamber 11 and the agitation chamber 12.

In addition, a first conveyance screw 13 serving as a first conveyance screw portion, a second conveyance screw 14 serving as a second conveyance screw portion, and a replenishment conveyance screw 31 serving as a replenishment conveyance screw portion that each convey the developer while agitating the developer are disposed in the developer container 2. To be noted, FIGS. 3 and 4 schematically illustrate a conveyance screw. FIGS. 3 and 4 illustrate an example in which the first conveyance screw 13, the second conveyance screw 14, and the replenishment conveyance screw 31 are each a single flight screw including a single blade. In contrast, the present embodiment will be described assuming that the first conveyance screw 13, the second conveyance screw 14, and the replenishment conveyance screw 31 are each a multi-flight screw including a plurality of blades. Specifically, each conveyance screw is a three-flight screw including a rotation shaft and three blades each formed in a spiral shape around the rotation shaft. To be noted, a modification example in which the first conveyance screw 13 and the second conveyance screw 14 are each a single flight screw while the replenishment conveyance screw is a multi-flight screw may be employed.

Figure 4:
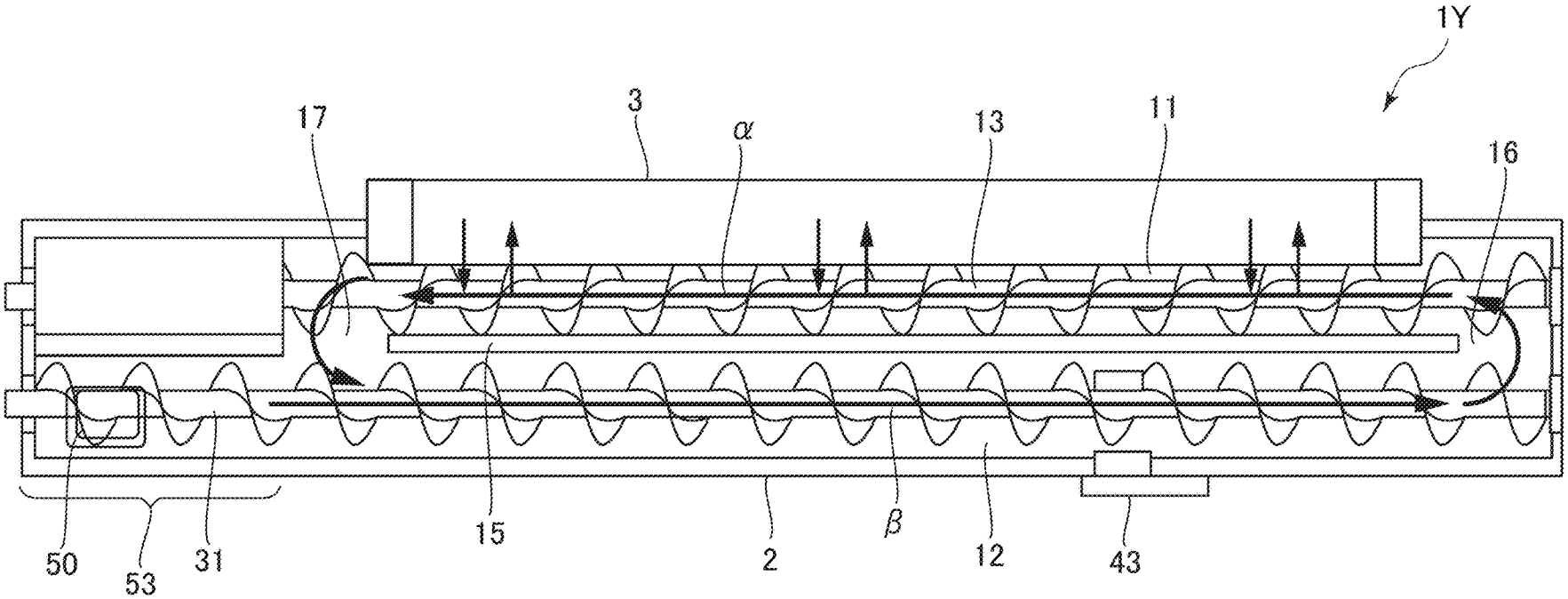
FIG. 4 illustrates the developing apparatus as viewed from above while omitting some parts thereof.

The first conveyance screw 13 is disposed in the developing chamber 11, and conveys the developer in the developing chamber 11 serving as a first conveyance path in an arrow a direction of FIG. 4 serving as a first direction while agitating the developer, and supplies the developer to the developing sleeve 3. The first direction is a direction from the communication portion 16 serving as a second communication portion toward the communication portion 17 serving as a first communication portion. The second conveyance screw 14 is disposed in the agitation chamber 12, and conveys the developer in the agitation chamber 12 serving as a second conveyance path in an arrow R direction of FIG. 4 serving as a second direction opposite to the first direction while agitating the developer. The second direction is a direction from the communication portion 17 toward the communication portion 16. The developer is conveyed by the first and second conveyance screws 13 and 14 in this manner, and circulates in the developer container 2 through the communication portions 16 and 17.

A replenishment conveyance path 53 is connected to the upstream side of the agitation chamber 12 with respect to the conveyance direction of the second conveyance screw 14, that is, with respect to the second direction. The replenishment conveyance path 53 is used for supplying replenishment developer to the circulation path. For this, a replenishment port 50 serving as a developer replenishment portion is provided in the replenishment conveyance path 53. The replenishment port 50 is connected to a replenishment conveyance portion 83 that is a replenishment pipe of a developer replenishment unit 80 illustrated in FIG. 3 that will be described later. The replenishment conveyance path 53 is positioned upstream of the second conveyance screw 14, and is disposed outside the developer circulation path that is coaxial with the second conveyance screw 14. Further, the replenishment port 50 and the replenishment conveyance portion 83 are provided above an upstream end portion of the replenishment conveyance path 53 in the vertical direction so as to be connected to a toner bottle 8.

In addition, the replenishment conveyance screw 31 is disposed in the replenishment conveyance path 53. The replenishment conveyance screw 31 conveys the developer in the replenishment conveyance path 53 toward the circulation path. That is, the replenishment conveyance screw 31 conveys the replenishment developer in a third direction from the replenishment port 50 toward the communication portion 17. The replenishment conveyance screw 31 is integrally formed with the second conveyance screw 14, in other words, is a part of the second conveyance screw 14. That is, the replenishment conveyance screw 31 is a section of the second conveyance screw 14 from an upstream end portion thereof to a portion connected to the developer circulation path. Therefore, the replenishment developer is supplied from the developer replenishment unit 80 to the replenishment conveyance path 53 through the replenishment conveyance portion 83 and the replenishment port 50, and is further supplied into the agitation chamber 12 by the replenishment conveyance screw 31 disposed in the replenishment conveyance path 53.

To be noted, an inductance sensor 43 serving as a toner concentration sensor that detects the toner concentration in the developer container 2 is provided in the developer container 2 as illustrated in FIG. 4. In the present embodiment, the inductance sensor 43 is provided on the downstream side of the agitation chamber 12 with respect to the developer conveyance direction.

The toner bottle 8 containing replenishment developer including toner and not including carrier or replenishment developer including toner and carrier is disposed above the developing apparatus 1Y so as to be attachable to and detachable from the image forming apparatus body as illustrated in FIG. 3. For example, the toner bottle 8 accommodates developer having a toner concentration 90%. The toner concentration is the ratio of the weight of toner particles to the total weight of carrier particles and toner particles, and is also referred to as a T/D ratio. In contrast, the toner concentration of the developer in the developing apparatus 1Y is 10% or less, for example, about 7% or more and 10% or less. That is, the toner bottle 8 accommodates developer having a toner concentration higher than the toner concentration of the developer circulating in the developing apparatus 1Y.

The developer replenishment unit 80 described above includes the toner bottle 8, a replenishment mechanism 81, and the replenishment conveyance portion 83. The toner bottle 8 is formed as a cylindrical container having a spiral groove on the inner wall thereof, and force for conveying the developer in the longitudinal direction, that is, the rotation axis direction is generated when the toner bottle 8 rotates. The replenishment mechanism 81 is connected to a downstream end portion of the toner bottle 8 with respect to the developer conveyance direction. The replenishment mechanism 81 includes a pump portion 81*a* that discharges the developer conveyed from the toner bottle 8 through a discharge port 82. The pump portion 81*a* is formed in a bellows shape. The capacity of the pump portion 81*a* changes and generates air pressure when rotationally driven, and discharges the developer conveyed from the toner bottle 8 through the discharge port 82.

The discharge port 82 is connected to an upper end portion of the replenishment conveyance portion 83, and a lower end portion of the replenishment conveyance portion 83 is connected to the replenishment port 50 of the developing apparatus 1Y for the developer. That is, the discharge port 82 and the replenishment port 50 communicate with each other through the replenishment conveyance portion 83. Therefore, the developer discharged through the discharge port 82 by the pump portion 81*a* is supplied into the developer container 2 of the developing apparatus 1Y through the replenishment conveyance portion 83.

To be noted, in the developing apparatus 1Y described above, the replenishment conveyance path 53 in which the replenishment port 50 is defined is provided on the upstream side of the agitation chamber 12 with respect to the developer conveyance direction and outside of the developer circulation path constituted by the developing chamber 11 and the agitation chamber 12. Specifically, the replenishment conveyance path 53 is provided more upstream in the agitation chamber 12 with respect to the developer conveyance direction than the communication portion 17. Therefore, the developer in the circulation path is hardly present near the replenishment port 50, and only the replenishment developer passes through the vicinity of the replenishment port 50.

Replenishment by the developer replenishment unit 80 having such a configuration is performed by automatic toner replenisher control. The automatic toner replenisher control will be also referred to as ATR control. In this ATR control, the developing apparatus 1Y is replenished with the developer by controlling the operation of the developer replenishment unit 80 in accordance with the image ratio of image formation, the inductance sensor 43, and a result of concentration detection of a patch image by a concentration sensor 101 illustrated in FIG. 1 that detects the concentration of a toner image.

As illustrated in FIG. 1, the concentration sensor 101 is disposed downstream of the most downstream image forming portion PK and upstream of the secondary transfer portion T2 with respect to the rotation direction of the intermediate transfer belt 24 so as to face the surface of the intermediate transfer belt 24. In the control using the concentration sensor 101, for example, a toner image for control that is a patch image is transferred onto the intermediate transfer belt 24 at a timing such as the start of an image forming job or each time images are formed on a predetermined number of sheets, and the concentration of the patch image is detected by the concentration sensor 101. Then, the replenishment control for the developer is performed by the developer replenishment unit 80 on the basis of the results of this detection.

To be noted, the configuration for replenishing the developing apparatus 1Y with the developer is not limited to this, and a conventionally known configuration may be used. For example, a configuration in which a hopper including a developer reserving portion that temporarily reserves the developer supplied from a toner bottle is provided between the toner bottle and a developing apparatus, and the developer is supplied from this hopper to the developing apparatus may be employed. In the case of this configuration, the hopper includes a screw for supplying the developer to the developing apparatus, and the replenishment of the developing apparatus is performed by controlling the driving of this screw similarly to the developer replenishment unit 80 described above.

Circulation of Developer

Next, circulation of the developer in the developer container 2 will be described in more detail with reference to FIG. 4. The first conveyance screw 13 and the second conveyance screw 14 are arranged approximately in parallel along the rotation axis direction of the developing sleeve 3. Further, the first conveyance screw 13 and the second conveyance screw 14 convey the developer in an opposite direction to each other along the rotation axis direction of the developing sleeve 3. In this manner, the developer is caused to circulate in the developer container 2 through the communication portions 16 and 17 by the first conveyance screw 13 and the second conveyance screw 14.

That is, due to the conveyance force of the first conveyance screw 13 and the second conveyance screw 14, the developer on the developing sleeve 3 whose toner concentration has decreased from consumption of the toner in a developing step is collected into the developing chamber 11, conveyed to the agitation chamber 12 through the communication portion 17, and moves in the agitation chamber 12. In addition, the developer in the developing chamber 11 not coating the developing sleeve 3 also moves in the developing chamber 11, and moves into the agitation chamber 12 through the communication portion 17.

Here, the replenishment conveyance path 53 to which the developer is supplied from the developer replenishment unit 80 is provided upstream of the communication portion 17 in the agitation chamber 12 with respect to the developer conveyance direction of the second conveyance screw 14. Therefore, in the agitation chamber 12, the developer conveyed from the developing chamber 11 through the communication portion 17 and the replenishment developer supplied from the replenishment conveyance path 53 are conveyed by the second conveyance screw 14 while being agitated. Then, the developer conveyed by the second conveyance screw 14 moves to the developing chamber 11 through the communication portion 16.

Generally, in a two-component developer system using toner and carrier, the toner and the carrier are each charged to a predetermined polarity by frictional contact therebetween. Therefore, the two-component developing system has a characteristic that the toner receives less stress than in a one-component developing system using one-component developer.

In addition, since the surface area of the carrier in the developer is larger than that of the toner, it is not likely that the carrier is stained by toner attaching to the surface of the carrier. However, after use of a long period, the stain or spent toner attached to the surface of the carrier increases, and thus the capability thereof for charging the toner gradually decreases. As a result of this, problems such as fogging and toner scattering occur. Although increasing the amount of carrier accommodated in a developing apparatus of a two-component developer system can be considered for elongating the lifetime of the developing apparatus, this is not desirable because this increases the size of the developing apparatus.

Therefore, in the developing apparatus 1Y of the present embodiment, an auto carrier refresh system: ACR system is employed. In the ACR system, increase of degraded carrier is suppressed by gradually discharging the developer whose charging performance has deteriorated from the developing apparatus while gradually replenishing the developer container 2 with new developer. The developing apparatus 1Y having such a configuration is configured to roughly maintain the collective height level of the developer in the developer container 2 by using the change in the collective height of the developer to discharge the degraded developer serving as an excess. According to the developing apparatus 1Y of this ACR system, the degraded carrier in the developer container 2 is gradually replaced by new carrier, and the charging performance of the carrier in the developer container 2 can be roughly maintained. In the developing apparatus 1Y of the ACR system described above, a replenishment developer having high toner ratio is used. Normally, the weight ratio of the carrier to the toner is about 5% to 10%. In other words, as the replenishment developer, a developer having a toner concentration of 90% or more, for example, 90% or more and 95% or less is used.

Developer

Here, the two-component developer used in the present embodiment will be described. As the developer, a mixture of negatively-chargeable nonmagnetic toner and positively-chargeable magnetic carrier is used. The nonmagnetic toner is powder of resin such as polyester, styrene, or acrylic resin including a colorant, a wax component, and the like which is formed by pulverization or polymerization and to the surface of which fine particles of titanium oxide, silica, or the like is added. The magnetic carrier is obtained by applying a resin coating on the surface of a core constituted by resin particles kneaded with ferrite particles or magnetic particles. The toner concentration in the developer in the initial state is set to 10% in the present embodiment.

Figure 5:
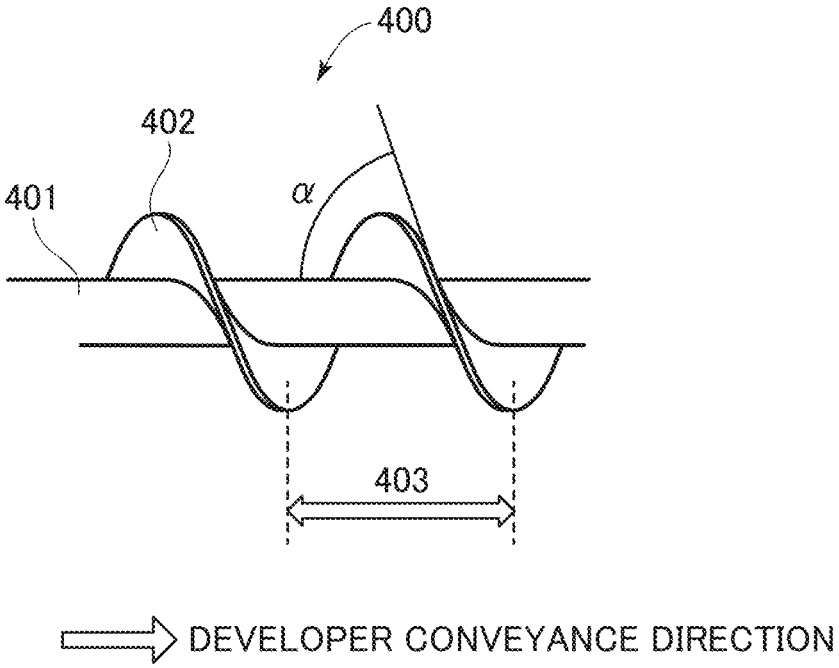
FIG. 5 illustrates the angle of a conveyance surface of a blade.

Next, the pitch and developer conveyance performance of a blade 402 in the case of using a single-flight conveyance screw 400 illustrated in FIG. 5 as a screw member that conveys the developer in the developer container will be described. The conveyance screw 400 includes a single blade 402 formed in a spiral shape around a rotation shaft 401. In the illustrated example, a case where the outer diameter of the screw is 14 mm is shown.

The developer conveyance amount per one rotation of the conveyance screw 400 changes in accordance with the pitch 403 of the blade 402. Assuming that all the developer is conveyed in accordance with the spiral blade 402, the distance in which the developer moves per one rotation of the conveyance screw 400 is equal to the pitch 403 of the blade 402. However, in reality, since some developer slides on the blade 402, not all the developer is conveyed in accordance with the blade 402. As the pitch 403 increases, an angle α of the conveyance surface of the blade 402 decreases, and thus the amount of developer that slides on the blade 402 increases. Regarding the behavior of the developer described above, toner has a lower fluidity than the two-component developer, therefore the movement of sliding on the blade less likely occurs for toner and the toner is more likely to be conveyed while being held by the blade, and thus the conveyance efficiency is higher.

Figure 6:
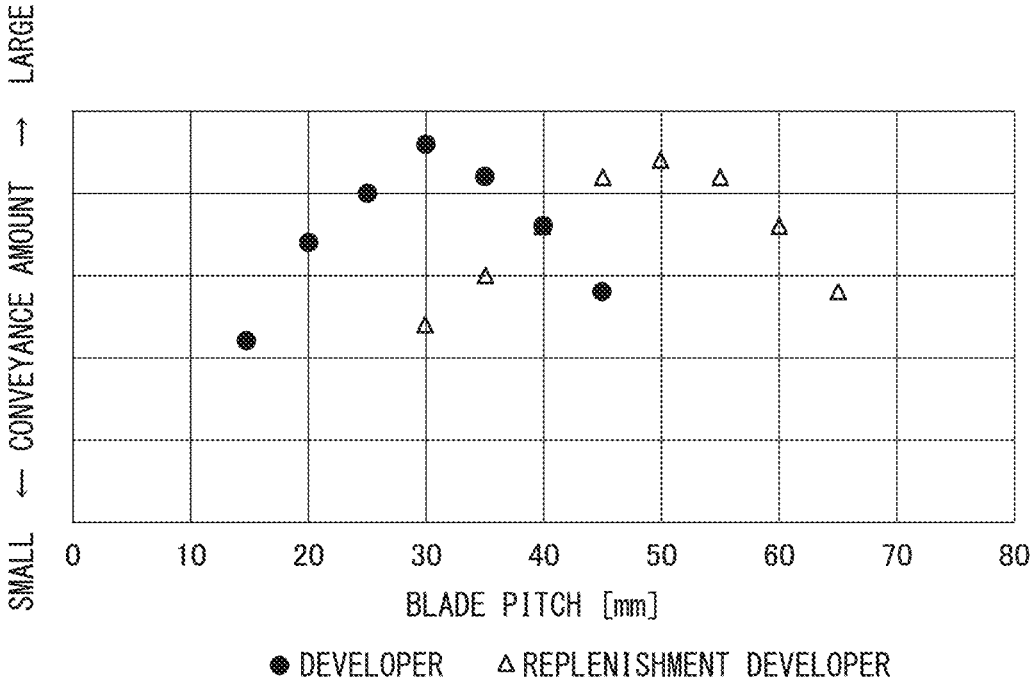
FIG. 6 is a graph illustrating a relationship between the pitch of blades and a developer conveyance amount.

FIG. 6 illustrates results of investigating the developer conveyance amount per one rotation while changing the pitch 403 of the blade 402. The relationship between the pitch 403 of the conveyance screw 400 and the developer conveyance amount per one rotation is expressed by a graph that is convex upward as illustrated in FIG. 6. In FIG. 6, the developer conveyance amount per one rotation is the largest when the pitch 403 is 30 mm. To be noted, since the shape of the graph illustrated in FIG. 6 changes in the case where the outer diameter of the screw is changed, the pitch applicable to the present embodiment is not limited to this.

Aggregates in Developer

Here, the miniaturization of the developing apparatus has progressed in recent years, and there is a tendency that the amount of two-component developer accommodated in the developing apparatus becomes smaller. Therefore, how well the replenishment developer can be agitated before being conveyed to the developing sleeve has become important for suppressing occurrence of abnormal images. Particularly, aggregates can be generated due to the thermal history during transportation of the replenishment developer, driving in the developer conveyance path in the image forming apparatus, or the like, and an image defect such as a stain image that looks like a stain on an image occurs when an aggregate is unintentionally supplied to the developing portion. Therefore, breaking the aggregates by the conveyance screw that is disposed in the developing apparatus to convey the developer is important for suppressing the stain images and improving the image quality.

However, since the aggregates mixed in the developer have a different specific gravity than the developer, the aggregates are often visualized as stain images in the developing portion after being conveyed while floating on the surface of the collection of the developer. Therefore, even if a configuration in which the second conveyance screw 14 disposed in the agitation chamber 12 is formed as a multi-flight screw and a discontinuous portion is provided in the blades as disclosed in Japanese Patent Laid-Open No. 2010-256429 is employed, a sufficient function of breaking the aggregates cannot be obtained. Further, since this configuration prioritizes the agitation performance, the developer conveyance performance is lower, and therefore there is a possibility that toner supply cannot keep up with the toner consumption.

In addition, in the case of using a space-saving developing apparatus that is smaller than a conventional configuration and accommodates less developer, the ratio of toner added for replenishment to the amount of developer is high and the circulation path of the developer is short. Further, the diameter of the conveyance screw and the like are smaller. This is disadvantageous for breaking the aggregates that cause stain images. In contrast, in the case where the conveyance screw is provided with an agitation member such as a paddle for breaking the aggregates, the conveyance performance for the developer is degraded.

Further, in the present embodiment, the developing apparatus 1Y is directly replenished with developer from the toner bottle 8 without using a hopper that is a reserving portion of the replenishment developer, to reduce the size of the image forming apparatus body. In the case of such a configuration, the result of measurement of mass varies a lot, and sometimes replenishment can be performed with developer of an amount larger than the replenishment amount of a conventional configuration, and therefore the aggregates in the replenishment developer have a greater influence. Therefore, as the miniaturization of the image forming apparatus body and the developing apparatus has progressed, the demand for a developing apparatus that can break the aggregates more has increased. Therefore, in the present embodiment, the replenishment conveyance screw 31 is configured as follows to improve the efficiency for breaking the aggregates and suppress the occurrence of stain images while suppressing deterioration of the conveyance performance even in the case of using a small and space-saving developing apparatus.

Replenishment Conveyance Screw

Next, a configuration of the replenishment conveyance screw 31 of the present embodiment will be described. The replenishment conveyance screw 31 includes a rotation shaft 310, and a plurality of blades 311 each formed in a spiral shape around the rotation shaft 310 as illustrated in FIG. 7B. Further, at least one of the plurality of blades 311 at least partially has a discontinuous portion 312 serving as a cutout portion where the blade 311 is discontinuous in the axial direction of the rotation shaft 310.

In addition, as described above, the replenishment conveyance path 53 is connected to the upstream side of the agitation chamber 12 with respect to the second direction that is the developer conveyance direction of the second conveyance screw 14. Further, the replenishment conveyance screw 31 disposed in the replenishment conveyance path 53 is disposed upstream of the second conveyance screw 14 with respect to the second conveyance screw 14, and includes the rotation shaft 310 that is shared with the second conveyance screw 14. That is, the replenishment conveyance screw 31 and the second conveyance screw 14 are integrally formed to share the same rotation shaft 310.

In addition, the second conveyance screw 14 also includes the rotation shaft 310 and a plurality of blades 14*a* each formed in a spiral shape around the rotation shaft 310. In addition, at least one of the plurality of blades 14*a* at least partially has a discontinuous portion 14*b* serving as a cutout portion where the blade 14*a* is discontinuous in the axial direction of the rotation shaft 310. In the present embodiment, the replenishment conveyance screw 31 and the second conveyance screw 14 are three-flight screws respectively including three blades 311 and three blades 14*a*, and discontinuous portions 312 and 14*b* are provided in two or more blades 311 and two or more blades 14*a* among these. Specifically, the discontinuous portions 312 and 14*b* are provided at a plurality of positions in each of the three blades 311 and the three blades 14*a*.

As described above, in the present embodiment, a multi-flight screw including a plurality of spiral blades 311 around the rotation shaft 310 serving as a screw shaft is employed as the replenishment conveyance screw 31. Since a plurality of spiral blades are provided around the screw shaft as described above, the number of blades that pass through a certain cross-section per one rotation of the screw increases in accordance with the number of the blades. Therefore, the conveyance performance of the screw is higher for a multi-flight screw. However, if the number of blades is increased too much, the volume of the space occupied by the screw per unit volume increases, and thus the amount of developer that can be held decreases and the conveyance force decreases. Therefore, by forming the replenishment conveyance screw 31 as a multi-flight screw, the efficiency for conveying the replenishment developer newly supplied from the developer container 2 by one rotation of the replenishment conveyance screw 31 is improved, and thus the developer can be efficiently supplied into the developer container 2.

Figure 7A:
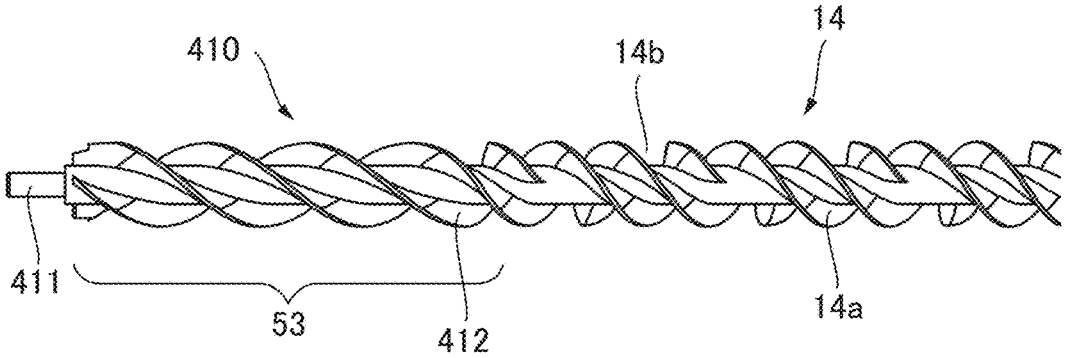
FIG. 7A is a side view of a conveyance screw according to a comparative example.
Figure 7B:
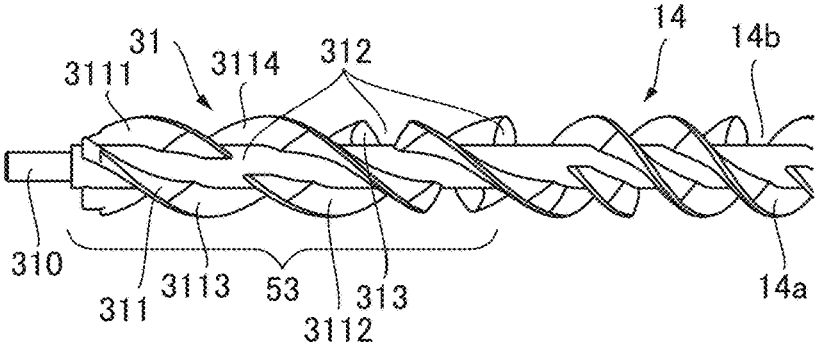
FIG. 7B is a side view of a conveyance screw according to the first embodiment.

FIG. 7A illustrates a replenishment conveyance screw 410 having no discontinuous portion in the blade thereof and the second conveyance screw 14 having a discontinuous portion as a comparative example. Also in the case of this comparative example, the replenishment conveyance screw 410 and the second conveyance screw 14 are each a three-flight screw. In addition, the second conveyance screw 14 has a discontinuous portion 14*b* in a blade 14*a*. Meanwhile, FIG. 7B illustrates the replenishment conveyance screw 31 and the second conveyance screw 14 of the present embodiment described above, FIG. 7C illustrates the range of a discontinuous portion 312, and FIG. 7D illustrates an interval between discontinuous portions 312.

Figure 8:
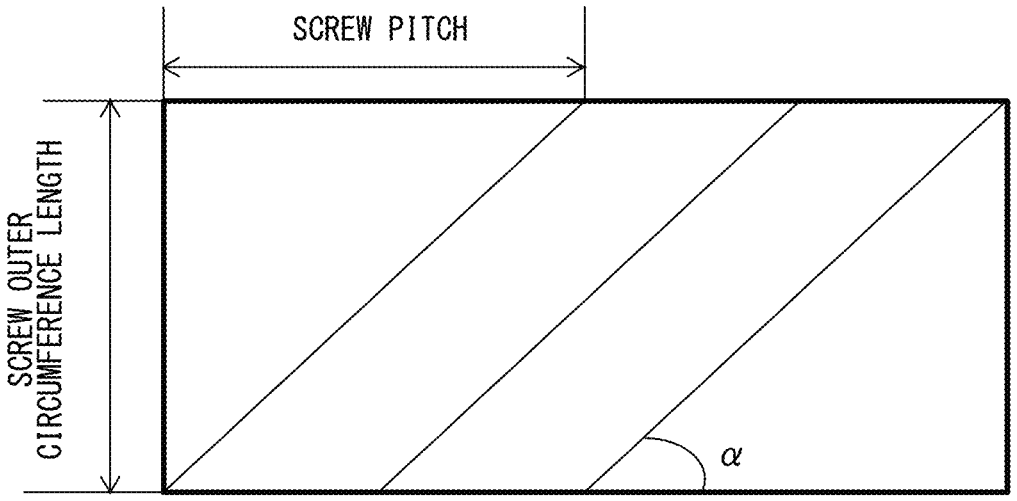
FIG. 8 is a schematic diagram for describing the angle of a blade.

FIG. 8 illustrates the three-flight screw described above spread into a planar shape in the circumferential direction of the screw. In FIG. 8, the vertical side represents the length of the outer circumference of the screw in a direction perpendicular to the rotation shaft of the conveyance screw, and the horizontal side represents the screw pitch, that is, the pitch of the blades of the conveyance screw in the rotation axis direction. In addition, each diagonal straight line represents the distance in which the outermost part of the three-flight screw travels per one rotation. In addition, the angle formed by a diagonal line and the horizontal axis in the case where the lengthwise direction of the outer circumference of a circle having the outer diameter of the blade as the diameter, that is, the screw outer circumferential length, is used as the vertical axis and the direction of the pitch of the blades is used as the horizontal axis is represented by an angle $\alpha$. The distance in which the outermost part of the screw travels will be also referred to as an outer circumference traveling distance. To be noted, the outer diameter of the blades serves as the outer diameter of the conveyance screw, and corresponds to the outer diameter of a circle having the distance from the center of the rotation axis to the outer circumference of the blade as the radius in the cross-section perpendicular to the rotation axis.

The outer circumference traveling distance of the three-flight screw per one rotation corresponds to the amount of developer conveyed per one rotation of the screw. More developer is conveyed in the case where this distance is larger, and this can be also similarly expressed that more replenishment developer and developer are conveyed and agitated. Here, the outer circumference traveling distance of the screw is determined on the basis of the outer diameter of the screw, the angle $\alpha$ of the blades, or the screw pitch, and selecting a screw outer diameter and an angle $\alpha$ that achieve good conveyance performance of the conveyance screw as described above is necessary.

The outer circumference traveling distance of a multi-flight screw is the sum of the outer circumference traveling distance of each blade, and when the screw is a multi-flight screw, the outer circumference traveling distance of the screw proportionally increases in accordance with the number of blades. This can be also expressed that the agitation performance of the screw is improved proportionally to the number of blades. However, when the number of blades is too large, the conveyance force might be lowered as described above.

Here, as illustrated in FIG. 6 described above, the relationship between the blade pitch of the conveyance screw and the developer conveyance amount per one rotation can be expressed by a graph that is convex upward. At this time, in the case where the developer in the developing apparatus is conveyed, the developer conveyance amount per one rotation is the largest when the blade pitch is 30 mm, and in the case where the replenishment developer having a higher toner concentration than this developer is conveyed, the developer conveyance amount per one rotation is the largest when the blade pitch is 50 mm. This is because the fluidity of the developer is different between the replenishment developer containing more toner and the developer circulating in the developing apparatus. For example, the replenishment developer has a toner concentration of 90% or more, and the developer circulating in the developing apparatus has a toner concentration of 10% or less.

Meanwhile, in the case of conveying the developer by a multi-flight screw, although the conveyance force increases, the blades and the space between the blades become smaller and thus the movement of the developer becomes smaller, and therefore, agitation performance in a microscopic region is difficult to obtain. Therefore, in the case where the replenishment developer contains aggregates and the replenishment conveyance screw 410 not having a discontinuous portion is used as the multi-blade screw as illustrated in FIG. 7A, it is difficult to sufficiently break the aggregates.

Therefore, in the present embodiment, the replenishment conveyance screw 31 is formed as a multi-flight screw as described above and the blades 311 are provided with discontinuous portions 312 that are gaps such that the aggregates in the replenishment developer are easily broken. In the case of the present embodiment, one discontinuous portion 312 is provided in each of the three blades 311 of the replenishment conveyance screw 31. In addition, one blade 311 includes a first blade portion 3111 and a second blade portion 3112 with the discontinuous portion 312 therebetween. In addition, the other two blades 311 of the three blades 311 each include a third blade portion 3113 and a fourth blade portion 3114. Further, the third blade portion 3113 is continuously formed in a region between the terminal end of the first blade portion 3111 with respect to the third direction and the starting end of the second blade portion 3112 with respect to the third direction, the region being displaced in the circumferential direction of the replenishment conveyance screw 31 from the terminal end of the first blade portion 3111 and the starting end of the second blade portion 3112. In the present embodiment, the fourth blade portion 3114 is also continuously formed in a region between the terminal end of the first blade portion 3111 with respect to the third direction and the starting end of the second blade portion 3112 with respect to the third direction, the region being displaced in the circumferential direction of the replenishment conveyance screw 31 from the terminal end of the first blade portion 3111 and the starting end of the second blade portion 3112.

In addition, in the case of the present embodiment, the pitch of the plurality of blades 311 of the replenishment conveyance screw 31 serving as a screw pitch is set to be larger than the pitch of the plurality of blades 14*a* of the second conveyance screw 14. This is because the replenishment developer conveyed by the replenishment conveyance screw 31 and the developer circulating in the developing apparatus and conveyed by the second conveyance screw 14 are different in the fluidity. Specifically, since the replenishment developer having a higher toner concentration has a lower fluidity, the sliding movement of the developer to the front side in the conveyance direction through gaps between the blades 311 decreases when the pitch of the blades 311 is decreased, and the sliding movement of the developer to the rear side in the conveyance direction on the blades 311 decreases when the pitch of the blades 311 is increased. Therefore, the replenishment developer has a stronger tendency of being conveyed while being held between the blades 311 as illustrated in FIG. 6, and thus the conveyance amount thereof appears on the wider pitch side of the blades 311 than the normal developer.

Figure 7C:
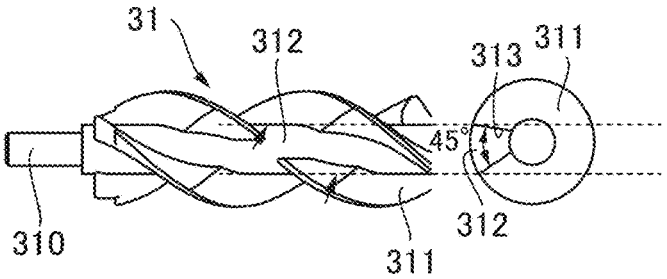
FIG. 7C includes a side view and a section view illustrating the range of a discontinuous portion.
Figure 7D:
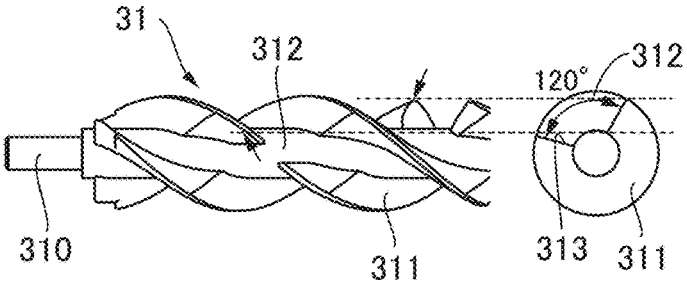
FIG. 7D includes a side view and a section view illustrating an interval between discontinuous portions of each blade.

As illustrated in FIG. 7C, the discontinuous portion 312 has a cross-section directed in a direction perpendicular to the developer conveyance direction, and the range of the discontinuous portion 312 is 45° out of 360° in the screw circumferential direction. This range of the discontinuous portion 312 is preferably equal to or larger than 30° and equal to or smaller than 90°. In the case where the range is smaller than 30°, the space is so narrow that the possibility that the developer being conveyed by the screw flows to the front of the cross-section of the discontinuous portion 312 and collides with the cross-section decreases. In contrast, in the case where the range is larger than 90°, the conveyance performance, which is an advantageous point of the multi-flight screw, is degraded greatly.

In addition, the cross-section of the blade 311 in the discontinuous portion 312, that is, a cutout surface 313 is a flat surface, and is formed to collide with the conveyed developer by the surface thereof. In addition, the cutout surface 313 is formed as a cross-section cut at an angle in the range of ±20° with respect to a direction perpendicular to the rotation shaft 310. That is, the cutout surface 313 is provided to be directed in a direction perpendicular to the circumferential surface of the rotation shaft of the replenishment conveyance screw 31. This cutout surface 313 is preferably in the range of ±20° with respect to a direction perpendicular to the circumferential surface of the rotation shaft. In the case where the cross-section is directed toward the plus side, if the cross-section is inclined more than 20° on the plus side, the replenishment developer is conveyed while being held, and therefore the aggregate breaking performance is degraded. In addition, in the case where the cross-section is inclined more than −20° on the minus side, the replenishment developer is conveyed while sliding on the cutout surface 313, and therefore the aggregate breaking performance is degraded.

In addition, the cutout surface 313 is formed as a cross-section cut in the range of ±30° with respect to a direction parallel to the developer conveyance direction of the replenishment conveyance screw 31. That is, the cutout surface 313 is a cross-section cut parallel to the conveyance direction, and in the case where the cutout surface 313 is inclined with respect to the direction parallel to the developer conveyance direction, the inclination is preferably in the range of about ±30°. In the case where the cutout surface 313 is inclined so as to face the downstream side in the developer conveyance direction, that is, the plus side, the relative speed of the conveyed developer when colliding with the cutout surface is low when the cutout surface 313 is inclined more on the plus side than +30° with respect to the parallel direction. Therefore, the aggregate breaking performance is degraded. In contrast, in the case where the cutout surface 313 is inclined so as to face the upstream side with respect to the developer conveyance direction, that is, the minus side, when the cutout surface 313 is inclined more on the minus side than −30° with respect to the parallel direction, the developer collides with the cutout surface 313 in a direction that interrupts the conveyance of the developer, and thus the breaking performance is slightly improved while the conveyance speed is lowered.

In addition, as described above, one discontinuous portion 312 is provided in each of the three blades 311 of the replenishment conveyance screw 31. At this time, the discontinuous portions 312 are preferably arranged such that centers of the discontinuous portions 312 are arranged at an interval of 120° in section view taken along a direction perpendicular to the rotation axis direction of the replenishment conveyance screw 31. If the discontinuous portions 312 are aligned in the axial direction or the circumferential direction or arranged at positions close to each other, a portion where the driving force from the blades 311 of the replenishment conveyance screw 31 is not transmitted to the developer is generated, and thus the conveyance force and the agitation force are reduced. Therefore, parts of other blades 311 adjacent to the discontinuous portion 312 of one blade 311 are preferably not the discontinuous portions 312 but portions where the blades are continuous.

Meanwhile, the container shape of the replenishment conveyance path 53 between the replenishment port 50 and the circulation path of the developer is preferably a sealed shape. By forming the surroundings of the replenishment conveyance screw 31 in a sealed shape such as a tunnel shape, the replenishment developer pushed up by the blades 311 of the replenishment conveyance screw 31 hits the top wall and returns into the range of the rotation radius of the replenishment conveyance screw 31. As a result of this, the frequency of the toner colliding with the cutout surface 313 of the discontinuous portion 312 described above increases, and the loss of conveyance force from the blades 311 can be suppressed to the minimum. Further, according to the same mechanism, the possibility of colliding with the cutout surface 313 increases, and the aggregate breaking performance and the conveyance performance are improved.

Test of Effects

Next, the results of testing the relationship between the conveyance performance of the replenishment conveyance screw 31 and the performance for breaking the aggregates in the developer will be described. In this test, to test the aggregate breaking performance of the replenishment conveyance screw 31, aggregates were formed in an accelerated manner in the replenishment developer by putting the developer in a high-temperature high-humidity chamber and leaving the developer to stand for a long period, and the resulting developer was used. Specifically, aggregate-testing replenishment developer that had been left to stand for 72 hours in a thermostat chamber at a temperature of 50° C. and a humidity of 50% was used.

Regarding the aggregate breaking performance, a developing apparatus including a prototype of the replenishment conveyance screw 31 was prepared. In addition, evaluation was made by counting the number of aggregates appearing on the developing sleeve 3 when a predetermined amount of the aggregate-testing replenishment developer formed in the accelerated method described above was charged into the replenishment port 50 for the replenishment developer.

In addition, to test the influence on the developer conveyance performance that adversely affects the aggregate breaking performance, the conveyance speed was evaluated by using the inductance sensor 43 illustrated in FIG. 4 disposed downstream of the replenishment conveyance screw 31 in the developer circulation path.

The developing apparatus used in this test had approximately the same configuration as the configuration illustrated in FIG. 2, and included the developing sleeve 3 that supplied toner to the photosensitive drum, the first conveyance screw 13, the second conveyance screw 14, the replenishment conveyance screw 31, the inductance sensor 43, and so forth.

Here, the inductance sensor 43 will be described. The inductance sensor 43 is a concentration sensor that detects information about the magnetic permeability of the developer. The inductance sensor 43 is disposed to oppose the second conveyance screw 14 such that a detection surface projects from the inner wall of the developer container 2 in a region downstream of the second conveyance screw 14 with respect to the conveyance direction as illustrated in FIG. 4. It is known from the relationship between the distance between the closest portions of the outer circumference of the second conveyance screw 14 and the sensor surface of the inductance sensor 43 that the distance between the closest portions is preferably set to about 0.2 mm to 2.5 mm. In the case where the distance is smaller than 0.2 mm, there is a possibility that the detection surface and the screw come into contact with each other to generate wear dust or the like. In contrast, in the case where the distance is larger than 2.5 mm, the developer in the space in which the sensor can perform detection is not replaced, and the change in the toner concentration derived from the circulation of developer cannot be measured. In consideration of the results of these tests, the distance between the closest portions is set to 0.5 mm in the present embodiment.

Since the inductance sensor 43 detects the magnetic permeability in a predetermined detection range from the detection surface, the detected magnetic permeability changes in accordance with the movement of the second conveyance screw 14. Specifically, the developer passes the detection surface of the inductance sensor 43 in accordance with the rotation period of the second conveyance screw 14. Therefore, the signal waveform of the magnetic permeability detected by the inductance sensor 43 has a maximum and a minimum corresponding to the movement of the second conveyance screw 14.

Here, the inductance sensor 43 detects the magnetic permeability of the developer every 10 ms. In addition, the detection for every 10 ms is performed for a time corresponding to one rotation of the screw corresponding to the time between a maximum and another maximum of the waveform, that is, a time that the screw takes to rotate once and that is obtained from the rotation speed of the screw, and the average value of the magnetic permeability in this time is calculated as the detection value of the inductance sensor 43.

As described above, the developer that is a two-component developer is constituted by magnetic carrier and nonmagnetic toner. When the toner concentration, that is, the ratio of the weight of toner particles to the total weight of carrier particles and toner particles, of this developer changes, the magnetic permeability depending on the mixing ratio of the magnetic carrier and the nonmagnetic toner also changes. This change in the magnetic permeability is detected by the inductance sensor 43 to measure the toner concentration. As a result of this, information on various things such as whether toner in the developing apparatus is excessive or insufficient, the circulation period of the replenishment developer, and the like can be obtained, and control can be performed such that a uniform toner image can be formed on the photosensitive drum.

Next, the evaluation criteria for the aggregate breaking performance in this test will be described. In this test, 200 g of developer having a toner concentration of 10% was charged in the developing apparatus, and the developing apparatus was set on a jig for driving the developing apparatus. In addition, a line camera was placed to oppose the opening portion of the developing sleeve 3. The line camera was focused on the portion where the opening portion of the developing sleeve 3 and the photosensitive drum oppose each other, and the field angle was adjusted such that the entirety of the coated region of the developing sleeve 3 in the longitudinal direction was within the field of view. The imaging conditions were set such that 10 images each corresponding to 1.0 second and corresponding to printing on one sheet of A4 size were taken at 500 fps.

In addition, a predetermined amount of the replenishment developer including the aggregates described above was charged as the replenishment developer into the replenishment port 50 of the developing apparatus that was not operating, and the images were recorded by starting imaging by the line camera described above at the same time as the start of development. The aggregates started appearing on the image at about the fifth image corresponding to a time when the replenishment developer was conveyed by the second conveyance screw 14 and began reaching the developing sleeve 3. At this time, the evaluation can be easily made if the replenishment developer and the developer accommodated in the developing apparatus are of different colors. In this test, yellow toner was used in the replenishment developer, and cyan toner was used for the developer accommodated in the developing apparatus.

Figure 9:
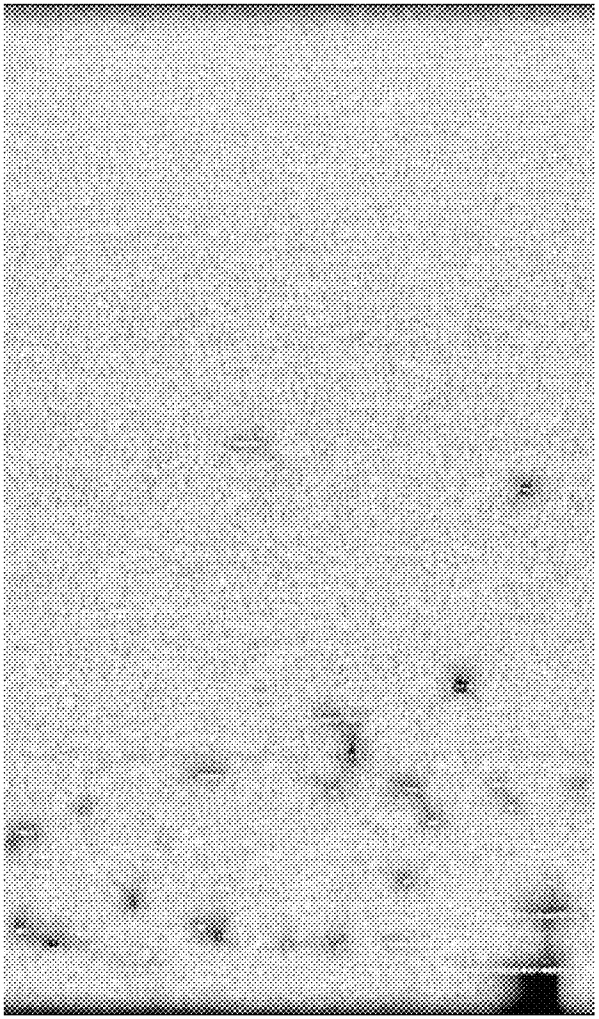
FIG. 9 is a diagram visualizing a stain image.

By using image processing software Image J, the captured images were decomposed into R, G, and B elements, and contrast emphasizing processing was performed on the images of the G element to visualize images of the aggregates. FIG. 9 shows an example of such an image. The number of aggregates that appeared in the ten images captured in this manner was counted to verify the effect of the present embodiment.

To verify the effect of the present embodiment, a configuration in which the blades 311 of the replenishment conveyance screw 31 have the discontinuous portions 312 as illustrated in FIG. 7B was prepared as Example 1, and a configuration in which the blades 311 of the replenishment conveyance screw 410 do not have a discontinuous portion as illustrated in FIG. 7A was prepared as a Comparative Example. Then, the respective replenishment conveyance screws were used, and the number of aggregates appeared on the developing sleeve 3 was counted as described above. The amount of replenishment developer at this time was set to four levels of 0.125 g, 0.250 g, 0.400 g, and 0.800 g in consideration of an image forming job of a small developer consumption and an image forming job of a large developer consumption.

Figure 10A:
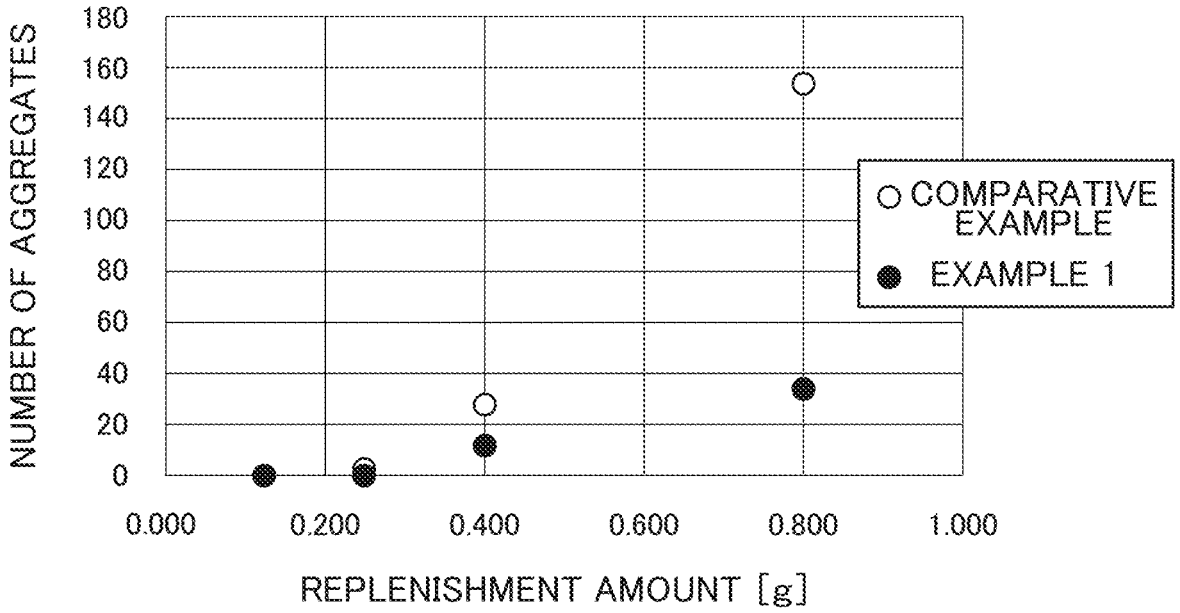
FIG. 10A is a graph illustrating a relationship between a developer replenishment amount and the number of aggregates.

FIG. 10A illustrates the results of the test described above. As can be seen from FIG. 10A, there was no substantial difference between Example 1 and the Comparative Example in the case of 0.125 g and 0.250 g in which the amount of replenishment developer was small, and a good result in which the occurrence of aggregates on the developing sleeve 3 was subtle was obtained in both configurations. However, in the amount of replenishment developer equal to or larger than 0.400 g, the aggregates were not sufficiently broken and a large amount of aggregates appeared on the developing sleeve 3 in the Comparative Example.

In contrast, in Example 1, the occurrence of aggregates on the developing sleeve 3 was greatly suppressed particularly in the replenishment amount region of 0.800 g. In addition, the occurrence of aggregates was also sufficiently suppressed in the replenishment amount region of 0.400 g as compared with the Comparative Example.

Figure 10B:
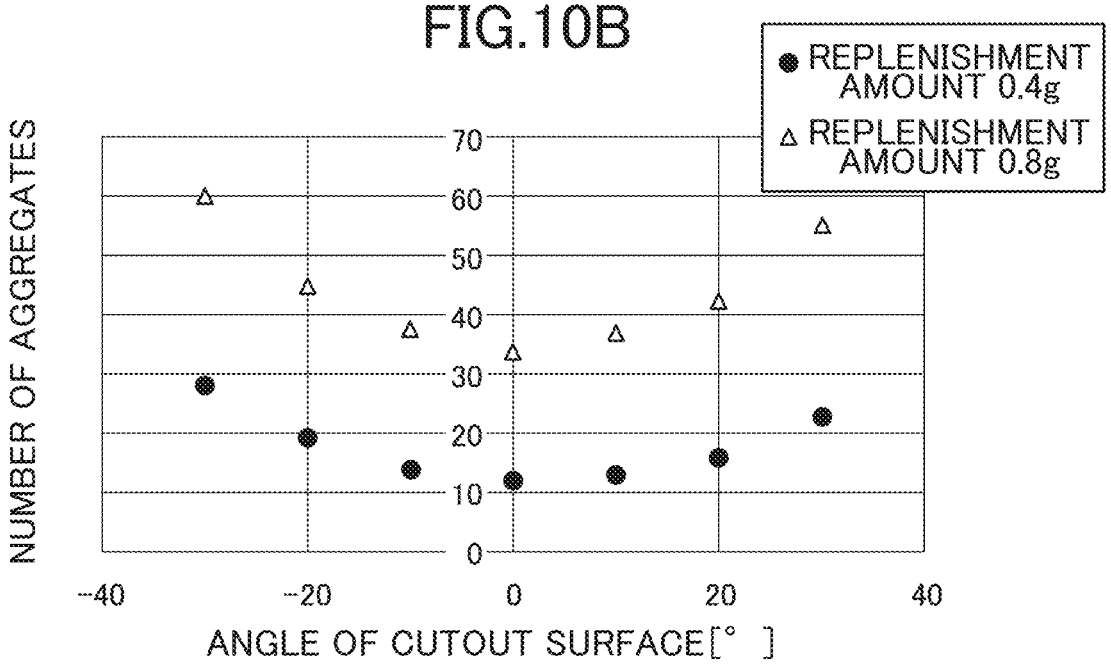
FIG. 10B is a graph illustrating a relationship between the angle of a cutout cross-section of a discontinuous portion and the number of aggregates.

In addition, FIG. 10B shows the tendency of the amount of generation of aggregates in the case of changing the angle of the cutout surface 313. Here, the cutout surface 313 was set in the range of ±30° with respect to the direction perpendicular to the rotation shaft 310 of the replenishment conveyance screw 31 with the angle of a cross-section perpendicular to the rotation axis 310 being 0°, and the number of aggregates of each case was compared. The amount of the replenishment developer was set to 0.400 g and 0.800 g.

It was confirmed that the aggregates were broken the best in the case where the cutout surface 313 was directed perpendicularly, that is, where the angle was 0°, and the breaking performance greatly deteriorated when the angle of the cutout surface 313 exceeded the range of ±20° with respect to the perpendicular direction. As can be seen from this, the angle of the cutout surface 313 is preferably set within the range of ±20° with respect to the direction perpendicular to the rotation shaft 310.

As can be seen from the test results described above, by using the configuration of the present embodiment, the aggregates in the replenishment developer can be sufficiently broken, and occurrence of stain images can be suppressed. Particularly, the occurrence of stain images can be suppressed even in the case where the configuration of the present embodiment is applied to a small developing apparatus, and thus a high-quality image forming apparatus can be provided.

Second Embodiment

A second embodiment will be described with reference to FIGS. 11 to 13. In the present embodiment, the sectional area of the cutout surface of the discontinuous portion is changed from that of the first embodiment described above. The other elements and effects are substantially the same as in the first embodiment described above. Therefore, the substantially same elements are denoted by the same reference signs and description and illustration thereof are omitted or simplified, and points different from the first embodiment will be mainly described below.

Figure 11:
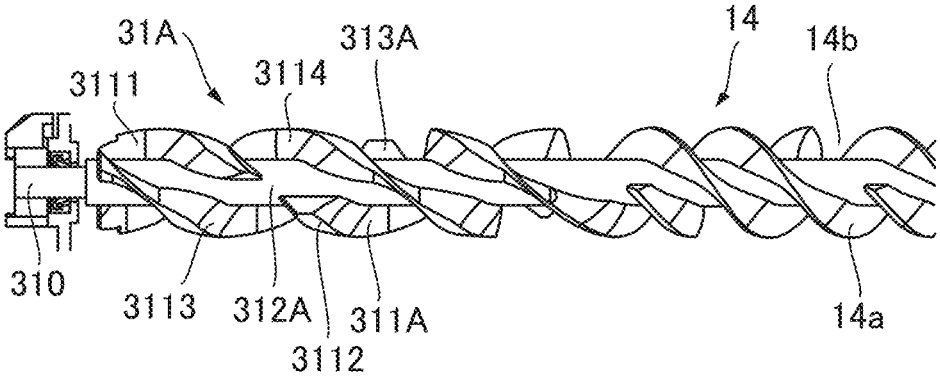
FIG. 11 illustrates a conveyance screw according to a second embodiment.

FIG. 11 illustrates a replenishment conveyance screw 31A and the second conveyance screw 14 of the present embodiment. In the present embodiment, the shape of the cross-section of a blade 311A in a discontinuous portion 312A, that is, the shape of a cutout surface 313A is changed to increase the sectional area thereof. The sectional area of the cutout surface 313A is set to be larger than the average sectional area of the continuous portion where the blade 311A of the replenishment conveyance screw 31A is continuous.

Specifically, in the shape of the spiral blade 311A of the replenishment conveyance screw 31A, knob-like portions where the thickness thereof is larger than a normal thickness are periodically provided in the blade 311A, and the discontinuous portion 312A is provided in the portion where the thickness of the blade 311A is large. By providing the discontinuous portion 312A at a portion where the thickness of the blade 311A is large, the sectional shape of the cutout surface 313A is made a trapezoidal shape wider than that of the cutout surface 313 of the first embodiment. As a result of this, the sectional area of the cutout surface 313A of the present embodiment is increased in the rotation axis direction.

By increasing the sectional area of the cutout surface 313A in this manner, the probability of contact with aggregates increases, and thus the aggregate breaking performance can be improved. Meanwhile, the increase in the sectional area affects the developer conveyance performance of the replenishment conveyance screw 31A. If the sectional area of only the discontinuous portion 312A is increased to form a knob-like shape, the blade therearound spreads in a skirt shape, thus a surface perpendicular to the conveyance direction is generated, and the conveyance is interrupted even though the aggregate breaking performance is improved.

Specifically, when the sectional area is equal to or larger than about 2.5 times of the sectional area of the first embodiment, the developer conveyance performance is degraded by 15% or more, and the aggregate breaking performance and the developer conveyance performance cannot be achieved at the same time. To be noted, whereas the discontinuous portion 312 of the first embodiment is defined without changing the thickness of the blade 311, the discontinuous portion 312A of the second embodiment is defined in a part of the blade 311A where the thickness of the blade 311A is increased as described above.

Next, an experiment in which the replenishment conveyance screw 31 of the first embodiment corresponding to Example 1 and the replenishment conveyance screw 31A of the second embodiment corresponding to Example 2 were prepared and which was conducted to investigate the number of aggregates for each example will be described. In the experiment, the number of aggregates was checked similarly to the test described above while changing the ratio of the sectional area of the cutout surface 313A of Example 2 to the sectional area of the cutout surface 313 of Example 1. This sectional area ratio is expressed by sectional area of the cutout surface 313A/sectional area of the cutout surface 313. To be noted, this sectional area ratio was changed by changing the sectional area of the cutout surface 313A. In addition, at this time, the time until the replenishment developer reached the inductance sensor 43 serving as a delay time was investigated by using a peak variation value Δ [%] of the inductance sensor 43.

Figure 12A:
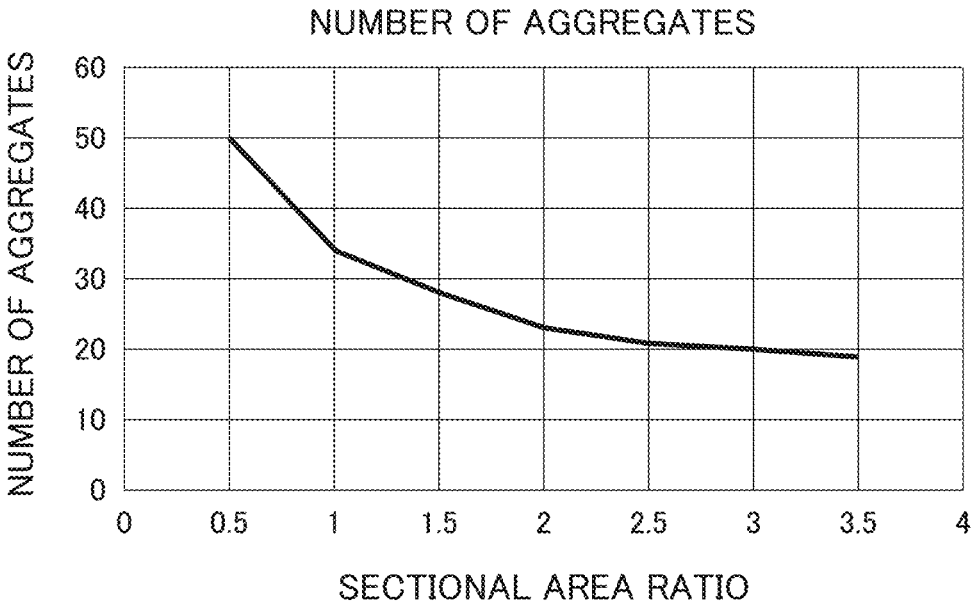
FIG. 12A is a graph illustrating a relationship between a sectional area ratio of a discontinuous portion and the number of aggregates.
Figure 12B:
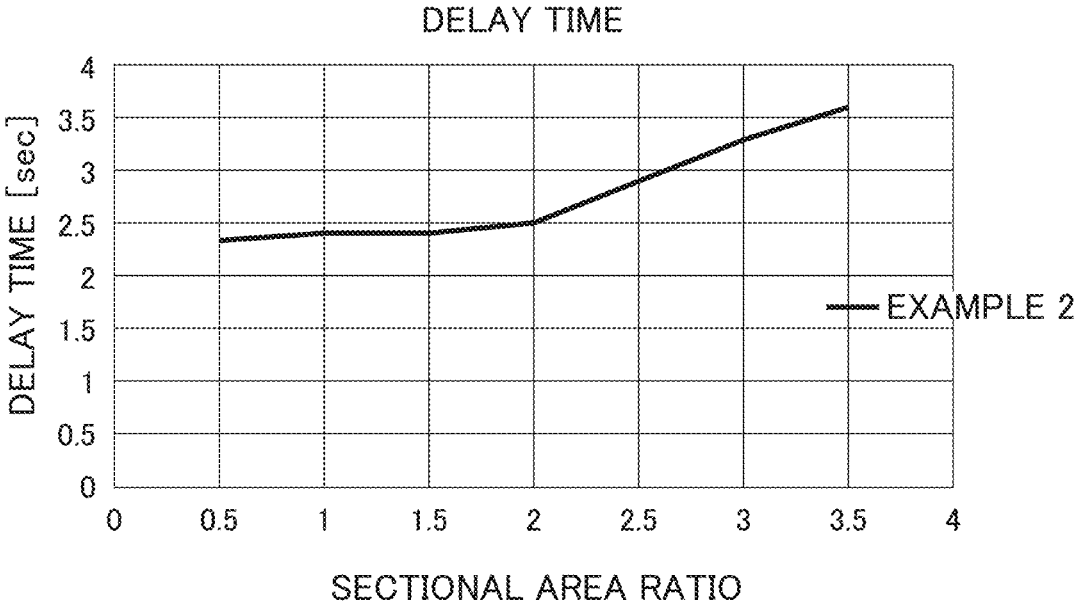
FIG. 12B is a graph illustrating a relationship between the sectional area ratio of the discontinuous portion and a delay time.
Figure 13:
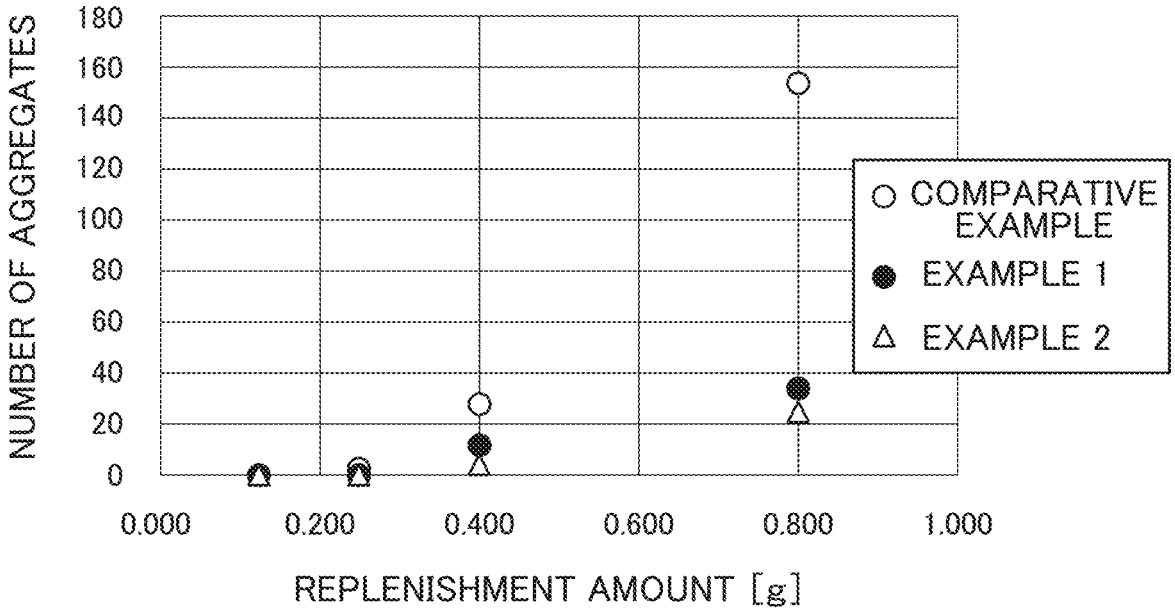
FIG. 13 is a graph illustrating a relationship between the developer replenishment amount and the number of aggregates.

The results of this are shown in FIGS. 12A and 12B. FIG. 12A illustrates the relationship between the sectional area ratio and the number of aggregates, and FIG. 12B illustrates the relationship between the sectional area ratio and the delay time. As can be seen from FIGS. 12A and 12B, a tendency that the conveyance performance and the aggregate breaking performance could be achieved at the same time was obtained up to a case where the sectional area ratio of the sectional area of the cutout surface 313A of Example 2 to the sectional area of the cutout surface 313 of Example 1 was 2.0. For example, it is assumed that the sectional area of a part of the blade 311A of the replenishment conveyance screw 31A of the second embodiment where the thickness is the smallest is equal to the sectional area of the cutout surface 313 of Example 1. In this case, the aggregate breaking performance can be improved while suppressing deterioration of the developer conveyance performance if the sectional area of the cutout surface 313A is equal to or smaller than 2.0 times of the sectional area of the part of the blade 311A where the thickness is the smallest.

Next, results of testing the aggregate breaking performance similarly to the test of the first embodiment for a configuration in which the sectional area of the cutout surface 313A of Example 2 is 1.8 times as large as the sectional area of the cutout surface 313 of Example 1, that is, a configuration in which the sectional area ratio is 1.8 will be described.

In Example 2, a configuration in which the replenishment conveyance screw 31A was a three-flight screw and each blade had one discontinuous portion 312A was employed. In addition, the three discontinuous portions 312A were arranged at an equal interval similarly to Example 1 such that the three discontinuous portions 312A are not aligned in either of the axial direction and the circumferential direction. The detailed dimensions of the replenishment conveyance screw 31A were, screw pitch: 50 mm, diameter of blade 311A: φ14 mm, and diameter of rotation shaft 310: φ6 mm.

In addition, in Example 2, the thickness of the blade 311A of the replenishment conveyance screw 31A was changed to increase at the position of the discontinuous portion 312A so as to increase the sectional area of the cutout surface 313A as illustrated in FIG. 11. However, as a method for increasing the sectional area of the cutout surface 313A, a method different from changing the thickness of the blade may be employed. For example, the area of the cutout surface may be increased by providing a rib-shaped member on the cutout surface of the blade.

In such a configuration, the stain images appearing on the developing sleeve 3 when the aggregate-testing replenishment developer containing aggregates was put in the developer container 2 were checked similarly to the test of the first embodiment. The results of this are shown in FIG. 13. The graph of FIG. 13 shows the number of aggregates on the developing sleeve 3 in the stain images with respect to the replenishment amount. In addition, FIG. 13 also shows the results of the Comparative Example and Example 1 shown in FIG. 10A. As can be seen from FIG. 13, in Example 2, the number of aggregates was reduced as compared with Example 1.

As can be seen from the test results described above, by employing the configuration of the present embodiment, the aggregates in the replenishment developer can be broken further sufficiently than the configuration of the first embodiment, and occurrence of stain images can be suppressed. Particularly, occurrence of stain images can be suppressed even in the case where the present embodiment is applied to a small developing apparatus, and thus a high-quality image forming apparatus can be provided.

Third Embodiment

A third embodiment will be described with reference to FIGS. 14 to 15B. In the present embodiment, the replenishment conveyance path 53 is formed in a shape surrounding the replenishment conveyance screw 31A, and the discontinuous portion 312A is disposed at a merging portion 57 where the developer conveyed from the replenishment conveyance path 53 is mixed with the developer in the agitation chamber 12. The other elements and effects are substantially the same as in the second embodiment described above. Therefore, the substantially same elements are denoted by the same reference signs and description and illustration thereof are omitted or simplified, and points different from the second embodiment will be mainly described below. To be noted, the same applies to the case where the replenishment conveyance screw 31 of the first embodiment is the replenishment conveyance screw disposed in the replenishment conveyance path 53.

Figure 14:
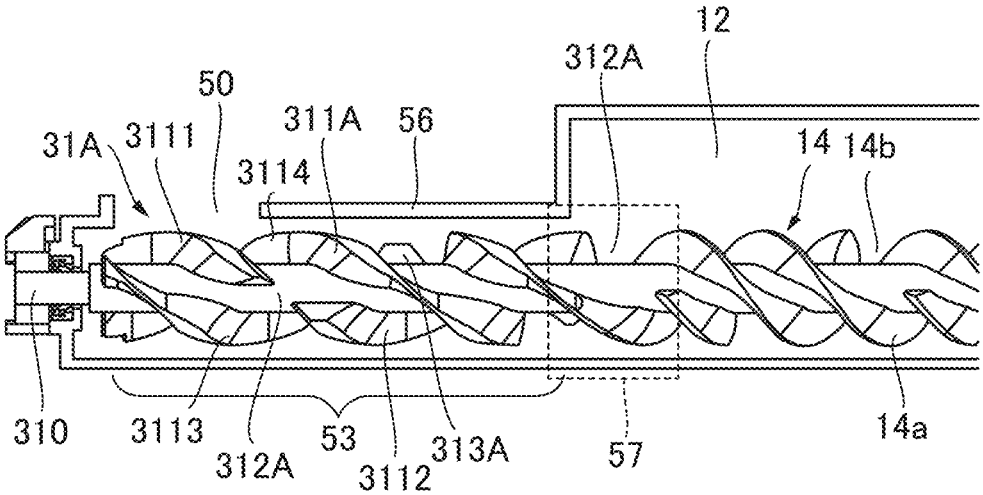
FIG. 14 is a section view of the vicinity of a replenishment conveyance path according to a third embodiment.

FIG. 14 illustrates the replenishment conveyance screw 31A and the second conveyance screw 14 disposed in the replenishment conveyance path 53 and the agitation chamber 12 of the present embodiment. Also in the present embodiment, the replenishment conveyance path 53 is configured to surround the replenishment conveyance screw 31A in the section from the replenishment port 50, through which the developer is supplied, to the circulation path. In addition, in the present embodiment, the discontinuous portion 312A is disposed at the merging portion 57 where the developer conveyed from the replenishment conveyance path 53 is mixed with the developer in the agitation chamber 12. Part of the replenishment conveyance screw 31A is in the agitation chamber 12.

Specifically, also in the present embodiment, the replenishment conveyance screw 31A including the three blades 311A provided with the discontinuous portions 312A is used similarly to the first embodiment and the second embodiment. In addition, the replenishment conveyance screw 31A is disposed coaxially to the second conveyance screw 14 as extension of the upstream side of the second conveyance screw 14, and the replenishment conveyance path 53 has, in the most upstream portion, the replenishment port 50 that is a connection portion to the replenishment conveyance portion 83 illustrated in FIG. 3 connected to the toner bottle 8 accommodating the replenishment developer.

Further, to break the aggregates in the replenishment developer more efficiently in the configuration described above, the container shape of the section from the merging portion 57 of the replenishment conveyance screw 31A and the second conveyance screw 14 to the replenishment port 50 is formed in a tunnel shape along the outer circumference of the replenishment conveyance screw 31A. When the replenishment developer mainly containing toner having a smaller specific gravity is conveyed by the replenishment conveyance screw 31A, the developer is likely to be struck up or scattered. Therefore, the replenishment conveyance path 53 is formed in a tunnel shape as described above such that the developer is likely to be kept within the range of diameter of the blades 311A by a top wall portion 56 to be affected by the replenishment conveyance screw 31A.

Next, the arrangement of the discontinuous portions 312A of the replenishment conveyance screw 31A of the present embodiment will be described. In the present embodiment, since a three-flight screw is used as the replenishment conveyance screw 31A, one discontinuous portion 312A is provided in each blade, that is, three discontinuous portions 312A are provided in total. To efficiently break and agitate the aggregates in the replenishment developer, not disposing a discontinuous portion 312A at the position of the replenishment port 50 with respect to the third direction and disposing a discontinuous portion 312A at the merging portion 57 with the circulation path for the developer is important.

Therefore, in the present embodiment, the first discontinuous portion 312A counted from the upstream side in the conveyance direction is disposed downstream of the replenishment port 50 in the replenishment conveyance path 53. In the case where the discontinuous portion 312A is disposed at the position of the replenishment port 50, since a large space is generated in the upper side in the vertical direction, the developer colliding with the cutout surface 313A of the discontinuous portion 312A and the blade 311A temporarily floats in the air and not taken into the conveyance path, and thus the conveyance efficiency is degraded.

In contrast, when the discontinuous portion 312A is disposed at a part where the top wall portion 56 of the replenishment conveyance path 53 is provided, the aggregates having collided with the cutout surface 313A hit the top wall portion 56, bounce back, and return into the range of rotation radius of the replenishment conveyance screw 31A. This increases the possibility of colliding with the cutout surface 313A again and suppresses loss of conveyance by the striking up, and thus the conveyance efficiency can be maintained. The top wall portion 56 of the replenishment conveyance path 53 may be disposed to extend over the entirety of the region of the replenishment conveyance screw 31A from the replenishment port 50 to the merging portion 57, or may be provided only in a region above the discontinuous portion 312A. The second discontinuous portion 312A is disposed at the center portion of the replenishment conveyance path 53 such that an effect equivalent to that of the first discontinuous portion 312A can be obtained.

Meanwhile, the third discontinuous portion 312A is disposed at the merging portion 57. In other words, the replenishment conveyance screw 31A is provided to extend from the replenishment conveyance path 53 to the communication portion 17 illustrated in FIG. 4. In the merging portion 57, two kinds of powder having different specific gravities, that is, the replenishment developer mainly containing toner particles and the developer mainly containing carrier particles are mixed and conveyed. Here, the replenishment developer and the developer are not easily mixed because the specific gravities thereof are greatly different from each other. As the initial intention, it is expected that the replenishment developer and the developer are conveyed in a mixed state. However, in the case of using the replenishment conveyance screw 410 not having a discontinuous portion as illustrated in FIG. 7A, it is often the case that the replenishment developer having a small specific gravity is gradually mixed with the developer in the circulation path while temporarily stagnating without being mixed by colliding with the developer in the circulation path. In this case, the effect of dispersing the replenishment developer by the replenishment conveyance screw 410 is lost.

To avoid this, in the present embodiment, the discontinuous portion 312A is disposed at the merging portion 57 such that the replenishment developer and the developer in the circulating path are mixed without stagnating. That is, by disposing the discontinuous portion 312A at the merging portion 57, the developer in the circulation path collides with the cutout surface 313A, thus the developer density in the merging portion 57 substantially becomes lower, and since a space is provided, the developer is agitated better with the replenishment developer. As a result of this, the replenishment developer can be supplied into the developer circulation path without decrease in the conveyance force while breaking the aggregates.

Next, an experiment conducted to test the aggregate breaking performance similarly to the test of the first embodiment by using the configuration described above as Example 3, and an experiment conducted at this time to investigate the delay time described in the second embodiment will be described. That is, in the experiments, evaluation on the aggregate breaking performance and the peak variation value Δ [%] of the inductance sensor 43 when the aggregate-testing replenishment developer containing aggregates were put in the developer container 2 were checked. In addition, the sectional area ratio of the replenishment conveyance screw 31A of Example 3 was set to 2.5.

Figure 15A:
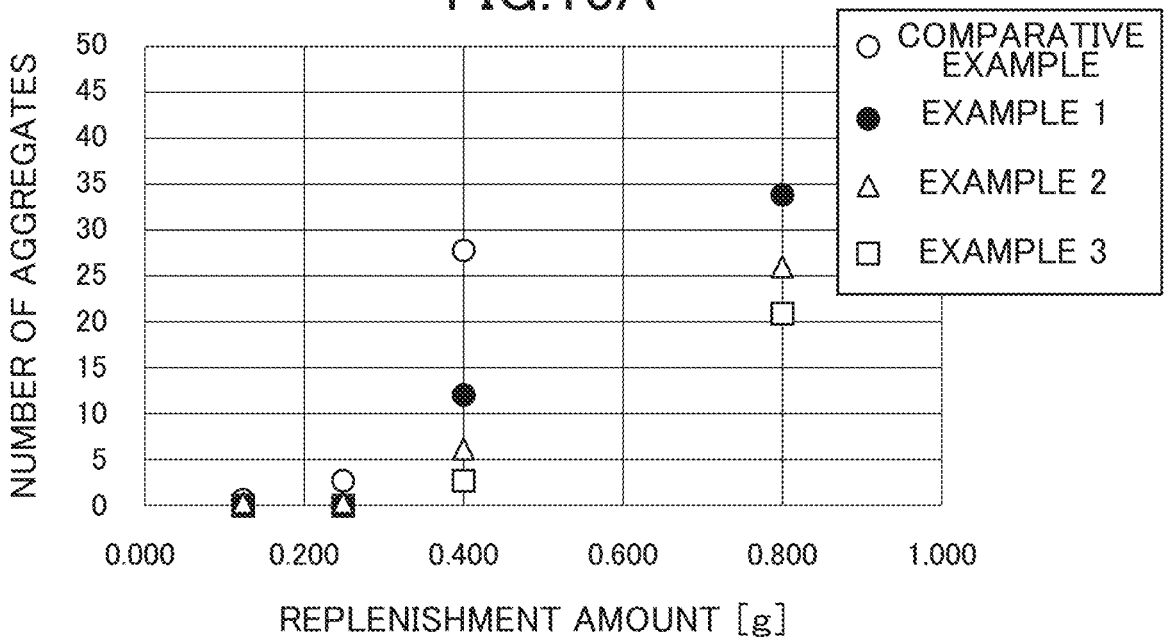
FIG. 15A is a graph illustrating a relationship between the developer replenishment amount and the number of aggregates.
Figure 15B:
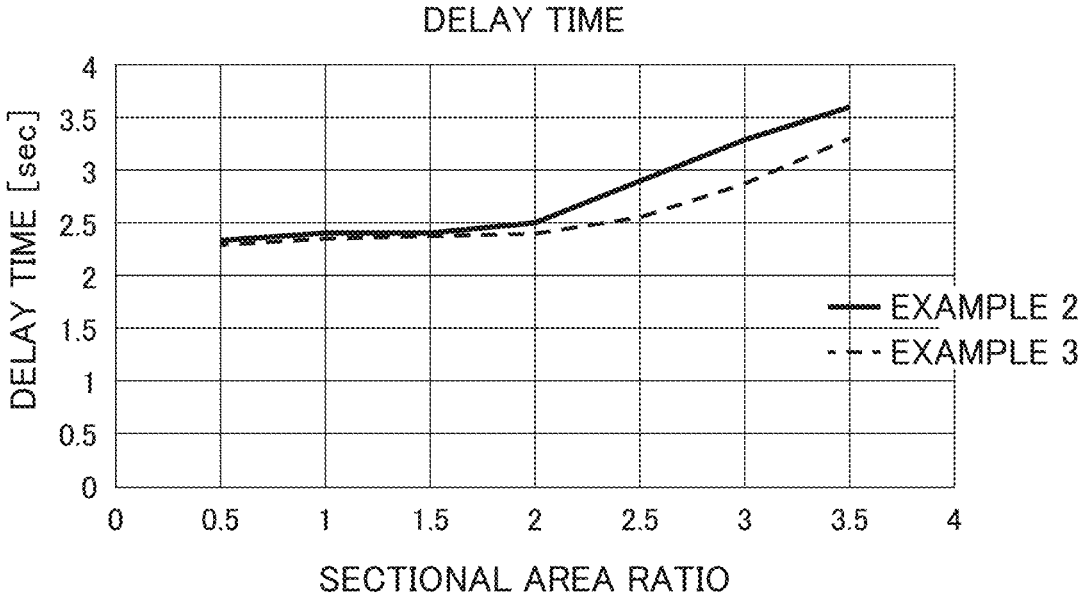
FIG. 15B is a graph illustrating a relationship between the angle of a cutout cross-section of a discontinuous portion and the number of aggregates.

The results of this experiment are shown in FIGS. 15A and 15B. The graph of FIG. 15A represents the number of aggregates on the developing sleeve 3 in the stain images with respect to the replenishment amount. In addition, FIG. 15A also shows the results of the Comparative Example and Examples 1 and 2 shown in FIG. 13. The graph of FIG. 15B shows the results of investigating the time until the replenishment developer reached the inductance sensor 43 while changing the sectional area ratio. This time is also referred to as a delay time.

As can be seen from FIG. 15A, in the case of Example 3, a tendency that the number of stain images visible on the developing sleeve 3 decreased more with respect to the configurations of the Comparative Example and Examples 1 and 2 as the amount of replenishment developer increased was obtained. In addition, as can be seen from FIG. 15B, it was confirmed that increase in the delay time was suppressed even for Example 3 having a configuration in which the sectional area ratio was set to 2.5 such that the aggregates could be reduced. As a result of this, it is confirmed that a configuration in which the loss of conveyance speed is small even in the case of improving the agitation performance can be obtained by using the configuration of Example 3.

As can be seen from the results of experiments described above, according to the configuration of the present embodiment, a developing apparatus that can efficiently break the aggregates without the delay of conveyance of the replenishment developer can be provided.

Other Embodiments

The discontinuous portions described in the embodiments described above may be in any form as long as the discontinuous portions are portions where the blades are not continuous. For example, blades having a smaller outer diameter than these blades may be present between blades adjacent in the direction along the spiral shape. That is, a shape in which part of the blades on the outer circumferential side that is continuous in the axial direction is cutout partially in the axial direction may be employed, and this cutout portion may be used as a gap portion.

Although a configuration in which the image forming apparatus is a printer has been described in the embodiments described above, the present invention is also applicable to copiers, facsimile machines, multifunctional apparatuses, and so forth. In addition, a configuration in which in the developing apparatus, developer is supplied from the developing chamber to the developing sleeve and then collected from the developing sleeve into the developing chamber has been described in the embodiments described above. However, the present invention is also applicable to a configuration in which the developer is supplied from the developing chamber serving as a first conveyance path and collected into the agitation chamber serving as a second conveyance path disposed with the partition wall between the agitation chamber and the developing chamber. Further, in addition to a developing apparatus in which the first conveyance path and the second conveyance path are arranged in the horizontal direction, the present invention is also applicable to a configuration in which the first conveyance path and the second conveyance path are arranged in the up-down direction or have a positional relationship inclined with respect to the horizontal direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-191309, filed Nov. 18, 2020, which is hereby incorporated by reference herein in its entirety.

What is claimed is:

1. A developing apparatus comprising:

a developer bearing member configured to convey a developer containing toner and carrier to a developing position while bearing the developer, a developer container configured to accommodate the developer, the developer container comprising:

a first chamber for supplying the developer to the developer bearing member;

a second chamber partitioned from the first chamber by a partition wall;

a first communication portion configured to allow the developer to be communicated from the first chamber to the second chamber;

a second communication portion configured to allow the developer to be communicated from the second chamber to the first chamber;

a replenishment conveyance path for conveying replenishment developer to a circulation path in which the developer is circulated between the first chamber and the second chamber; and a developer replenishment portion configured to supply the replenishment developer to the replenishment conveyance path;

a first conveyance screw portion provided in the first chamber and configured to convey the developer in a first direction from the second communication portion toward the first communication portion;

a second conveyance screw portion provided in the second chamber and configured to convey the developer in a second direction from the first communication portion toward the second communication portion; and a replenishment conveyance screw portion provided in the replenishment conveyance path and configured to convey the replenishment developer in a third direction from the developer replenishment portion toward the first communication portion, wherein the replenishment conveyance path is provided upstream of the second chamber with respect to the second direction, wherein the second conveyance screw portion is provided downstream of the first communication portion and upstream of the second communication portion with respect to the second direction, wherein the replenishment conveyance screw portion is provided upstream of the second conveyance screw portion with respect to the second direction, wherein a rotation shaft of the replenishment conveyance screw portion is coaxial to a rotation shaft of the second conveyance screw portion, wherein the replenishment conveyance screw portion comprises:

a first blade portion formed in a spiral shape on an outer circumferential surface of the rotation shaft of the replenishment conveyance screw portion and configured to convey the replenishment developer in the third direction;

a second blade portion formed in a spiral shape on the outer circumferential surface of the rotation shaft of the replenishment conveyance screw portion and configured to convey the replenishment developer in the third direction; and a third blade portion formed in a spiral shape on the outer circumferential surface of the rotation shaft of the replenishment conveyance screw portion and configured to convey the replenishment developer in the third direction, wherein a pitch of the first blade portion, a pitch of the second blade portion, and a pitch of the third blade portion are each larger than a pitch of a blade of the second conveyance screw portion, and wherein the third blade portion is continuously formed in a region between a terminal end of the first blade portion with respect to the third direction and a starting end of the second blade portion with respect to the third direction, the region being displaced in a circumferential direction of the replenishment conveyance screw portion from the terminal end of the first blade portion and the starting end of the second blade portion.

2. The developing apparatus according to claim 1, wherein in a rotation axis direction of the replenishment conveyance screw portion, a gap is provided between the terminal end of the first blade portion and the starting end of the second blade portion.

3. The developing apparatus according to claim 1, wherein the terminal end of the first blade portion and the starting end of the second blade portion are each provided upstream of the first communication portion with respect to the second direction.

4. The developing apparatus according to claim 1, wherein the replenishment conveyance screw portion is provided to extend from the replenishment conveyance path to the first communication portion.

5. The developing apparatus according to claim 1, wherein the replenishment conveyance screw portion has a gap defined by the terminal end of the first blade portion and the starting end of the second blade portion, and a range of the gap is equal to or larger than 30° and equal to or smaller than 90° in the circumferential direction of the replenishment conveyance screw portion.

6. The developing apparatus according to claim 5, wherein the gap is provided at a merging portion where the replenishment conveyance path and the circulation path merge with each other.

7. The developing apparatus according to claim 5, wherein the gap is provided at a position displaced from the developer replenishment portion with respect to the third direction.

8. The developing apparatus according to claim 1, wherein the second conveyance screw portion comprises at least a part where a blade is not continuous in a rotation axis direction of the second conveyance screw portion.

9. The developing apparatus according to claim 1, wherein the replenishment conveyance screw portion further comprises a fourth blade portion formed in a spiral shape on the outer circumferential surface of the rotation shaft of the replenishment conveyance screw portion and configured to convey the replenishment developer in the third direction.

* * * * *